US012458154B2

(12) United States Patent
Thorne

(10) Patent No.: US 12,458,154 B2
(45) Date of Patent: Nov. 4, 2025

(54) PLAY YARD MATTRESS

(71) Applicant: Henry F. Thorne, Sewickley, PA (US)

(72) Inventor: Henry F. Thorne, Sewickley, PA (US)

( * ) Notice: Subject to any disclaimer, the term of this patent is extended or adjusted under 35 U.S.C. 154(b) by 281 days.

(21) Appl. No.: 18/135,267

(22) Filed: Apr. 17, 2023

(65) Prior Publication Data

US 2023/0248158 A1 Aug. 10, 2023

Related U.S. Application Data

(63) Continuation-in-part of application No. PCT/US2021/055353, filed on Oct. 18, 2021.

(60) Provisional application No. 63/092,548, filed on Oct. 16, 2020.

(51) Int. Cl.
*A47D 13/06* (2006.01)

(52) U.S. Cl.
CPC ..... *A47D 13/063* (2013.01); *A47D 13/065* (2013.01)

(58) Field of Classification Search
CPC . A47D 7/00; A47D 7/005; A47D 7/03; A47D 11/00; A47D 11/005; A47D 11/007; A47D 13/00; A47D 13/06; A47D 13/061; A47D 13/063; A47D 13/065; A47D 13/066; A47D 13/068; A47D 15/001; A47D 15/003
See application file for complete search history.

(56) References Cited

U.S. PATENT DOCUMENTS

| | | | | |
|---|---|---|---|---|
| 2,553,579 | A * | 5/1951 | Harris | A47D 13/065 5/99.1 |
| 2,586,251 | A * | 2/1952 | Peebles | A47D 13/065 5/2.1 |
| 5,233,710 | A * | 8/1993 | Bernard | A47D 7/04 5/426 |
| 5,293,656 | A * | 3/1994 | Chan | A47D 13/063 5/98.1 |
| 2008/0196163 | A1* | 8/2008 | Thorne | A47D 13/063 5/99.1 |
| 2012/0102641 | A1* | 5/2012 | Srour | A47D 7/03 5/93.1 |
| 2016/0286978 | A1* | 10/2016 | Sclare | A47D 9/016 |
| 2016/0309913 | A1* | 10/2016 | Peterson | A47D 15/003 |
| 2018/0192786 | A1* | 7/2018 | Horst | A47D 11/007 |

FOREIGN PATENT DOCUMENTS

CN 110367747 A * 10/2019

OTHER PUBLICATIONS

International Search Report and Written Opinion of the International Searching Authority for PCT Application PCT/US2021/055353 dated Jan. 19, 2022.

* cited by examiner

*Primary Examiner* — George Sun
(74) *Attorney, Agent, or Firm* — Blynn L. Shideler; Krisanne Shideler; BLK Law Group

(57) ABSTRACT

The present invention is directed to a mattress base for a child's play yard and to a folding child's play yard with a mattress that utilize securing mechanisms to secure the mattress base upon installation and to prevent a child from lifting the mattress base.

23 Claims, 16 Drawing Sheets

PLAY YARD MATTRESS

CROSS-REFERENCE TO RELATED APPLICATION

This application is a Continuation-in-Part Patent application claiming priority to PCT Patent Application Serial No. PCT/US2021/055353, filed on Oct. 18, 2021, which claims priority to U.S. Provisional Application Ser. No. 63/092,548, filed on Oct. 16, 2020, which is incorporated by reference herein in its entirety.

BACKGROUND OF THE INVENTION

Field of the Invention

The present invention is directed to a mattress for a child's play yard and to a folding child's play yard with a mattress that is structured to prevent a child from lifting the mattress without the use of straps and attachment points located underneath the play yard.

Description of Related Art

Foldable playpens, play yards, playyards, playards, playyard, pack and plays, and transportable crib devices (herein collectively referred to as "play yard(s)") are well known, as generally exemplified by U.S. Pat. No. 6,385,800 for a "Collapsible Playyard" to Chen et al., U.S. Patent Application Publication Nos. 20200187673 and 20200146465 for Play Yards to Thorne. The foldable devices disclosed therein, and most similar prior art play yards, are collapsible and transportable. Most play yards, historically and currently on the market, are sold with separate mattresses or floor pads (collectively referred to herein as a "mattress" or "mattress base") that need to be deployed and secured to the play yards prior to putting a child in the play yard. Many currently available mattresses are snug-fitting, sufficiently firm and secured with straps to prevent a child from lifting the mattress or rolling into a loose mesh pocket that can form between the edge of the mattress and the side of the play yard, which could create a suffocation or entrapment hazard. To set up or deploy most currently available folding play yards and to prepare them for use, first the play yard is opened or unfolded. Second, the mattress is unfolded and dropped into the open play yard. Third, straps that are attached to the mattress are fed through slots on the play yard fabric floor and secure (via Velcro® or snaps) to the underside of the play yard, where they cannot be accessed by a child inside of the play yard. These straps need to be secured to the underside of the play yard prior to putting a child into the play yard.

While this traditional securing strap mechanism solves potential child suffocation and entrapment problems by preventing a child who is inside the play yard from lifting the mattress, it only works if the user, who sets up the play yard, takes the time to secure these straps to the underside of the play yard. Herein lies the practical problem. While many play yards are designed with the securing strap mechanism, users often do not secure the straps prior to putting a child into the play yard for one or two main reasons. First, it is not intuitive to a person setting up a play yard, who has not read the instruction manual, that there are straps on the mattress that need to be inserted through slots on the play yard floor and then secured to the underside of the play yard. Second, it is cumbersome and, for some models, virtually impossible to secure the straps without flipping the entire play yard onto its side to see where the straps need to be secured, securing the straps, and then confirming that the user has properly secured the straps. Many of the currently available play yards have floors that sit so low to the ground that it is very challenging to secure the straps without turning the play yard onto its side to do so. Therefore, while many prior art play yards and mattresses are designed for the child's safety, the designs are impractical, cumbersome and/or not intuitive and, thus, result in many users simply dropping the mattress into the play yard and not securing it to the underside of the play yard prior to putting a child into the play yard. Therefore, a market and user need exist for a mattress that eliminates the extra steps of having to secure it to the underside of a play yard before putting a child into the play yard and, ideally, is self-secured by the mere act of inserting the mattress into the open play yard. The present invention meets these needs.

BRIEF SUMMARY OF THE INVENTION

One embodiment of the present invention is a mattress base system for securing a mattress base, which has an upper side, a lower side, and three or more corners in a structure, such as a play yard, having three or more corner posts that define an inside perimeter of the structure and a floor. The system of this embodiment comprises at least one stop and bracket assembly attached to at least one corner post, such that the bracket is located below and in close proximity to the lower side of the mattress base and the stop is located above and in close proximity to the upper side of the mattress base at a predetermined distance to accommodate and secure the mattress base. For this embodiment, when the at least one corner of the mattress base is inserted between the at least one stop and bracket assembly the at least one corner cannot be pulled upward.

Another embodiment of the present invention is a method of installing a mattress base comprised of pivotably connected panels and having at least three corners and at least four edges, into a play yard having at least two securing mechanisms. This embodiment of a method comprises folding or unfolding the mattress base at least partially to insert at least one of the mattress base corners or edges into at least one securing structure and then unfolding the mattress base fully within the play yard to create a secured and supportive surface for a child. For this embodiment, the at least two securing mechanisms comprise at least two stops secured above and in close proximity to the mattress base.

A third embodiment of the present invention is directed to a folding play yard for holding a child. The play yard of this embodiment comprises at least four upper rails; at least four corner posts inter-connected by the at least four upper rails to form a rectangular play yard; a floor spanning the area between the at least four corner posts; and a mattress base with at least four corners and that is comprised of a plurality of pivotably connected panels. This embodiment also comprises the use of at least two bracket and stop assemblies, wherein the brackets are attached to at least two diagonally opposing corner posts to support the mattress base and the stops are located on the at least two diagonally opposing corner posts at a predetermined position above the surface of the mattress base and that operate to receive and secure at least two corners of the mattress based from being lifted upward.

A fourth embodiment of the present invention is a mechanism to secure a mattress base within a play yard. According to this embodiment, the mattress base has an upper side and at least four edges. Additionally, according to this embodiment, the play yard has at least four sides and at least four corners. The mechanism of this embodiment comprises a plurality of stops located along the play yard's sides and in close proximity to the upper side of the mattress base and so that the mattress base's edges are located under the stops when the mattress base is installed in the play yard.

A fifth embodiment of the present invention is a mattress base for use with a child's play yard. According to this embodiment, the play yard has a plurality of upper rails, a plurality of corner posts defining an inside perimeter of the play yard, and a floor. The mattress, according to this embodiment, comprises a plurality of pivotably connected panels. Each panel is configured in size and shape so that the plurality of pivotably connected panels cover the play yard floor when the panels are fully unfolded. Additionally, a plurality of hinges connect the plurality of panels to one another. For this embodiment, all of the plurality of panels unfold in an inverted-V shape towards the play yard floor.

A sixth embodiment of a mattress for use with a child's play yard according to the present invention comprises a plurality of panels, wherein adjacent panels meet at a panel juncture; a plurality of anti-slip strips that are attached to the panels and configured to prevent the panels from slipping on top of one another; and a mattress cover that holds the panels adjacent to one another and wherein the cover is configured to fold at each panel juncture.

BRIEF DESCRIPTION OF THE SEVERAL VIEWS OF THE DRAWINGS

For the purpose of facilitating understanding of the invention, the accompanying drawings and descriptions illustrate preferred embodiments thereof, from which the invention, various embodiments of its structures, construction and method of operation and many advantages may be understood and appreciated. The accompanying drawings are hereby incorporated by reference.

DETAILED DESCRIPTION OF THE INVENTION

Figure 1:
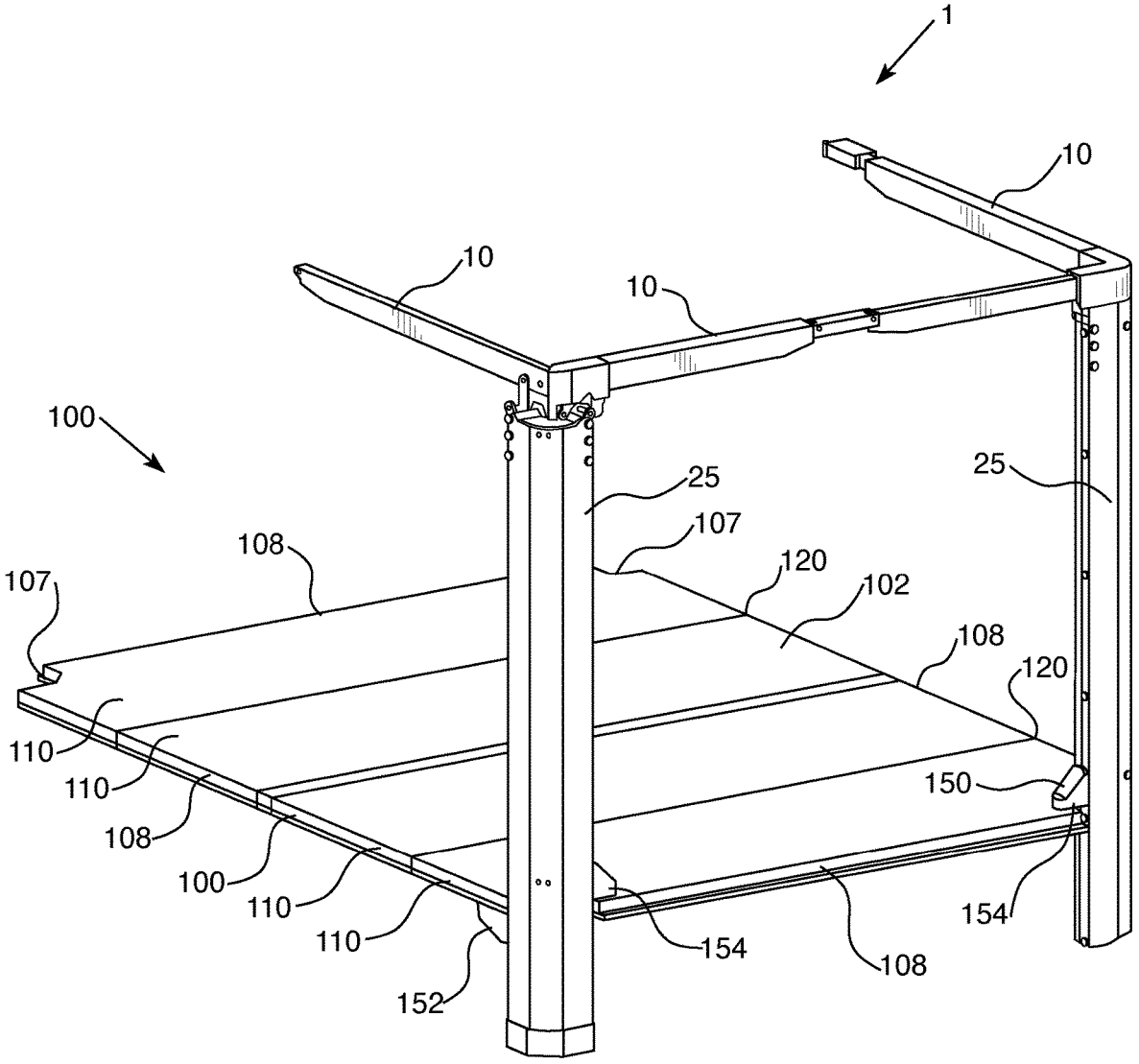
FIG. 1 illustrates an open mattress base sitting in an open play yard with one edge of the mattress base supported by brackets mounted to the corner posts and under stops mounted to the corner posts to secure the mattress base according to one embodiment of the invention.
Figure 2:
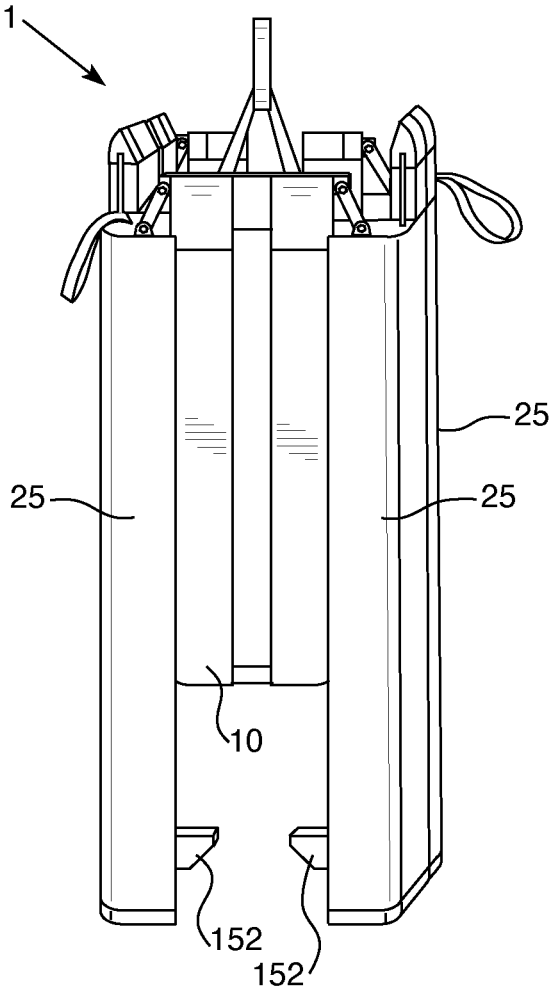
FIG. 2 illustrates an embodiment of a closed play yard according to one embodiment of the invention with two brackets visible on two corner posts respectively.
Figure 3:
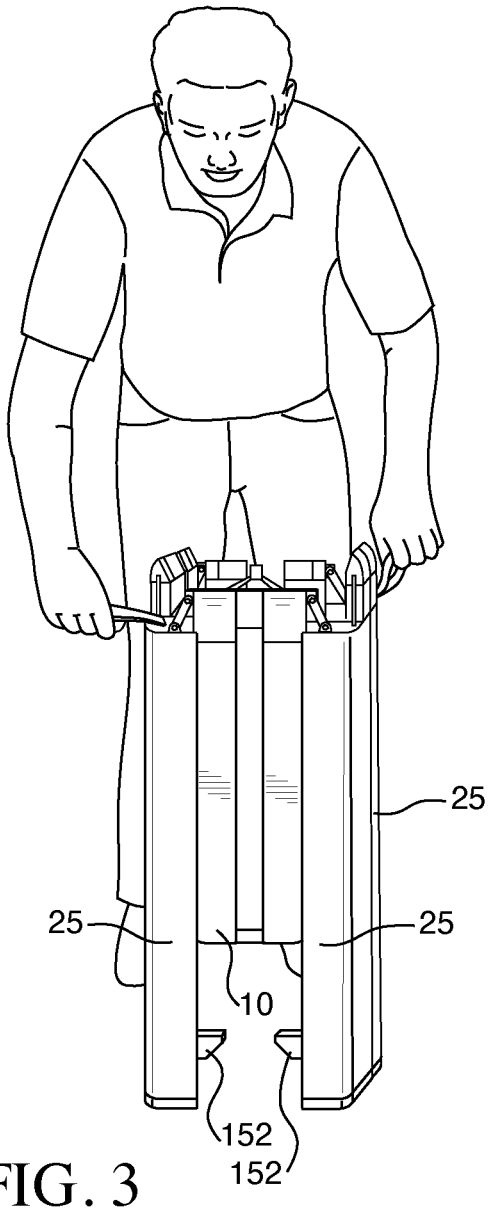
FIG. 3 shows the play yard of FIG. 2 about to be opened.
Figure 4:
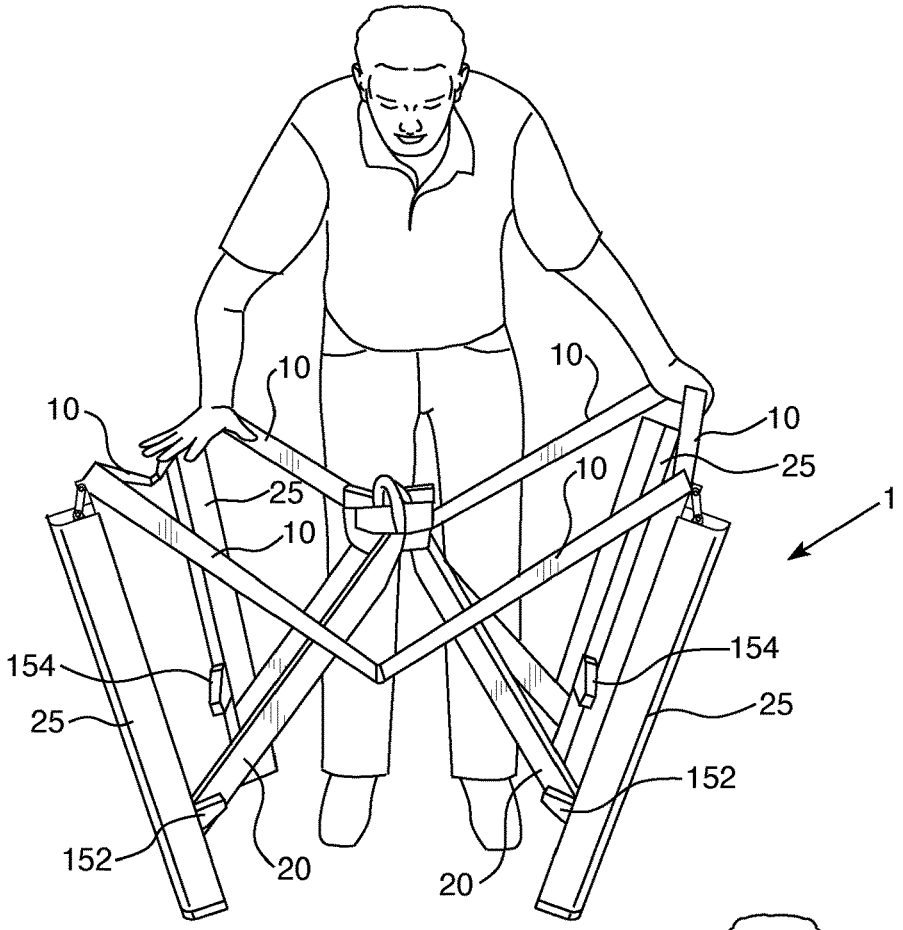
FIG. 4 shows the play yard of FIG. 3 in an intermediate position.
Figure 5:
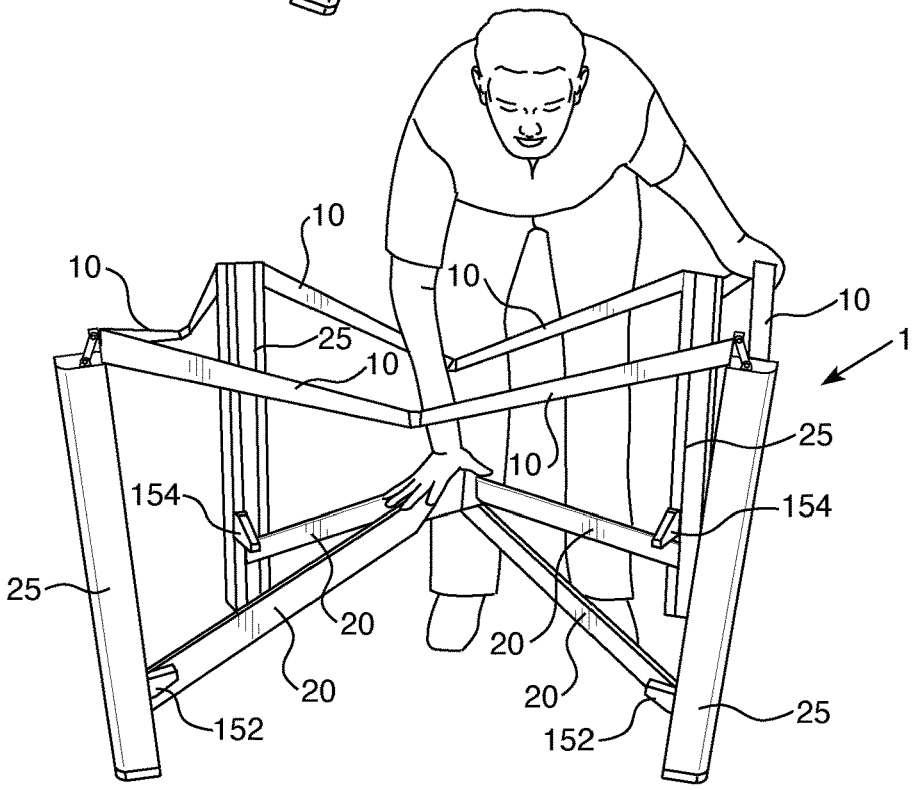
FIG. 5 shows the play yard of FIG. 4 almost fully opened.
Figure 6:
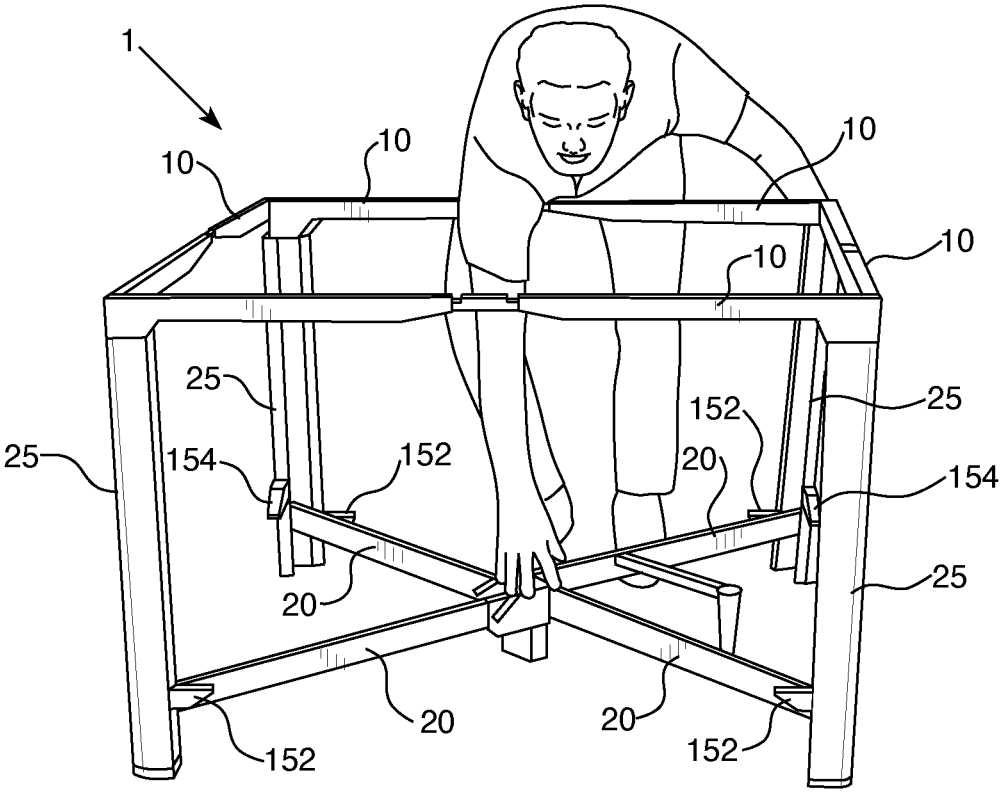
FIG. 6 shows the play yard of FIG. 5 fully opened.

The following describes example embodiments in which the present invention may be practiced. This invention, however, may be embodied in many ways and the descriptions provided herein should not be construed as limiting in any way. Among other things, the following invention may be embodied as systems, methods, or devices. The following detailed descriptions should not be taken in a limiting sense. The accompanying drawings are hereby incorporated by reference.

In this document, the terms "a" or "an" are used, as is common in patent documents, to include one or more than one. In this document, the term "or" is used to refer to a nonexclusive "or" such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

For purposes of the description hereinafter, the terms "upper", "lower", "right", "left", "vertical", "horizontal", "top", "bottom", "lateral", "longitudinal", and derivatives thereof shall relate to the invention as it is oriented in the figures. However, it is to be understood that the invention may assume alternative orientations, variations and step sequences, except where expressly specified to the contrary. It also is to be understood that the specific devices and processes illustrated in the attached drawings and described in this specification are simply exemplary embodiments of the invention. Hence, specific dimensions and other physical characteristics related to the embodiments disclosed herein are not to be considered as limiting.

As used herein, the terms "pivot" and "pivot point", when used as nouns (and "pivotably" when used as an adjective) mean a structural and functional connection between at least two components which allows at least partial rotation of the at least two components relative to one another. For example, a pivot between two panels means a physical connection between the two panels that permits at least partial rotation or movement of one panel relative to the other panel, and vice versa. The pivot may include a hinge or a hole in one or both of the panels, and an axial member extending through the hole(s) to constrain the adjacent panels to each other about a rotational axis. The axial member may include a pin, bolt, screw, bearing, bushing, wheel, or combination thereof to facilitate rotation of the first and second links relative to each other. A pivot also may be a fold wherein two components that are adjacent to one another pivot with respect to each other.

Similarly, the terms "hinge" and "hinged", etc. mean a structural and functional connection between at least to components which allows for the at least partial rotation of the two components relative to one another with that rotation having a secure limit or stopping point. A pivot may be created or achieved by using one or more hinges. There are many mechanical ways to achieve this movement, including but not limited to the use of one or more hinges, and all such mechanical alternatives are included within the use of the word "hinge" and variations thereof.

It will be obvious to one skilled in the art that there are numerous structures and mechanisms that can be used to create pivot points or hinged connection points between two or more elements to achieve the structural goals of the present invention and all such structures and mechanism are included within the scope of this application.

Figure 14:
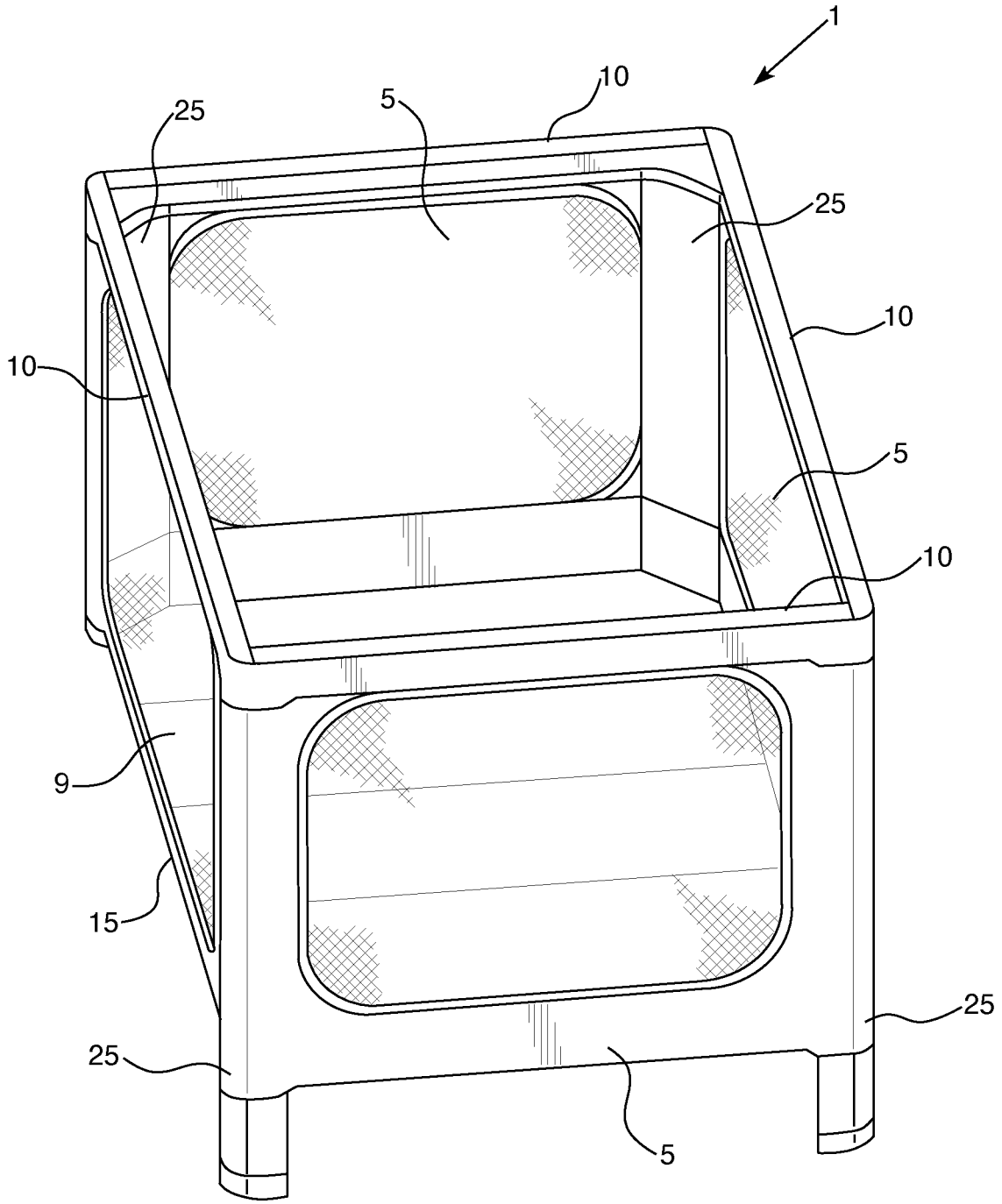
FIG. 14 illustrates a standard play yard.

An example of a standard play yard similar to what is currently on the market is illustrated in FIG. 14. As shown in FIG. 14, most standard play yards 1 are constructed to have a flexible material insert 5 that is attached to or around the upper rails 10 and drops down into the play yard 1 to create material or mesh sides and a material or mesh floor 15 that sits under a mattress 100 in a play yard 1. In addition to being attached to the upper rails 10, the material insert 5 can be attached to the corner posts 25, usually near their bottom, and also to the struts 20. These lower points where the material insert 5 attaches to the corner posts 25 and/or the struts 20 provide a tightness across the perimeter of the lower rectangle of the play yard 1 (the "floor 15") so that children cannot get their heads in between the fabric and the mattress 100. A preferred embodiment of the mattress base 100 of the present invention is designed to sit on or above this material insert floor 15 in a play yard 1 that is designed with a material insert 5 that, in a preferred embodiment, is secured to the lower corner posts 25 and/or the struts 20. However, variations of the basic embodiments can be made to implement the core invention with a wide variety of play yard 1 structures and with play yards in which the material insert 5 does not connect to the lower corner posts 25.

Figure 7:
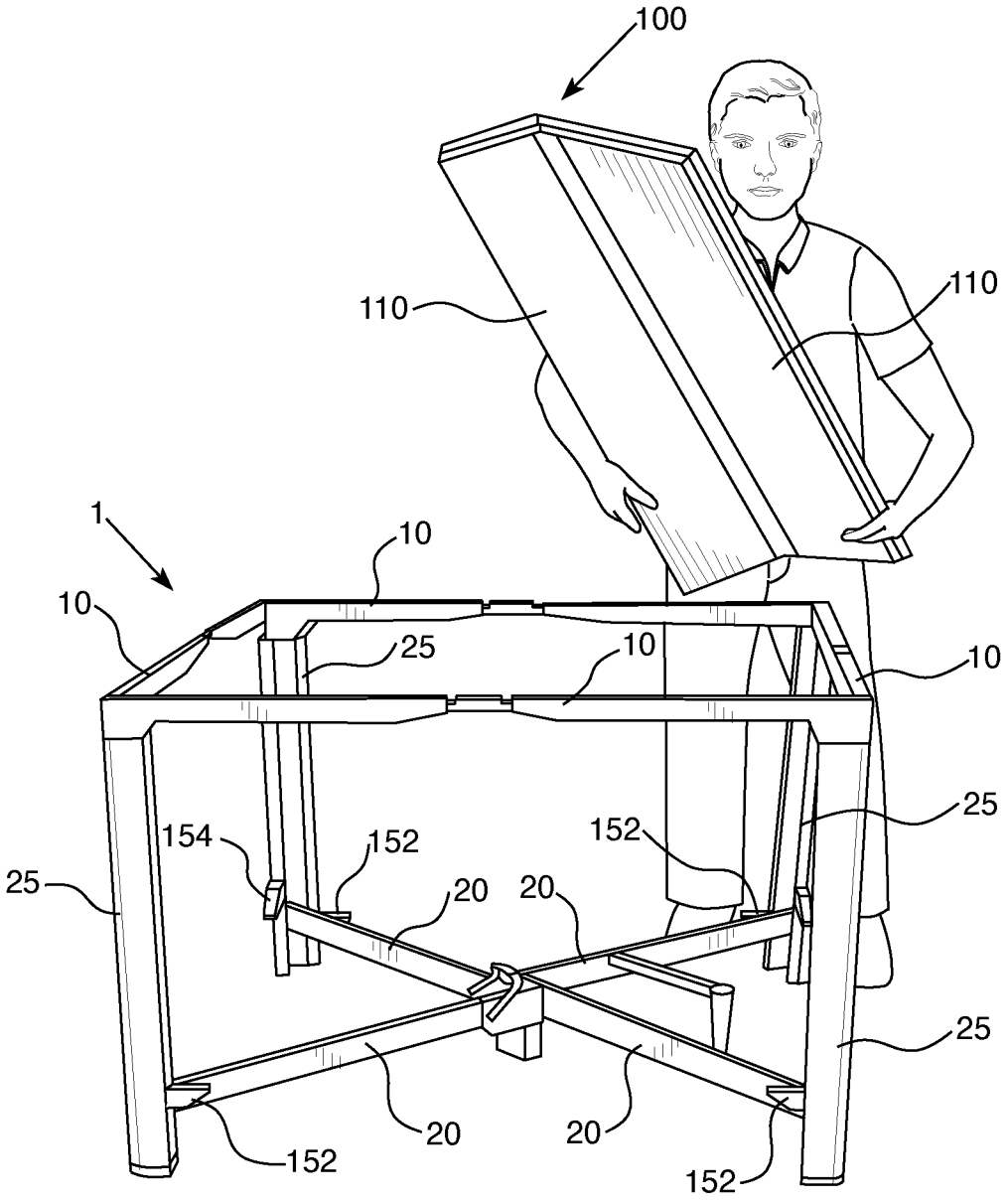
FIG. 7 illustrates the first unfolding of a mattress base according to one embodiment of the invention from the fully folded position to an intermediate position and a fully open play yard with four brackets and three stops visible.
Figure 8:
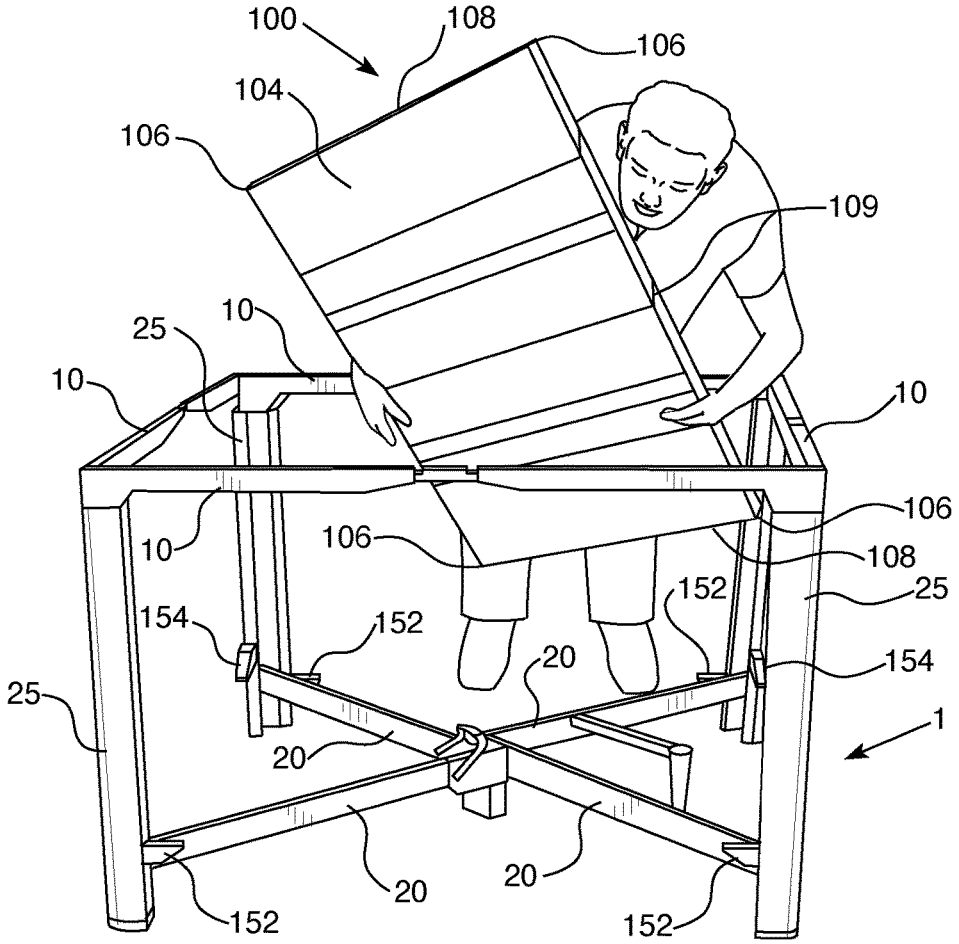
FIG. 8 illustrates the mattress base of FIG. 7 being further unfolded and inserted into the open play yard.
Figure 9:
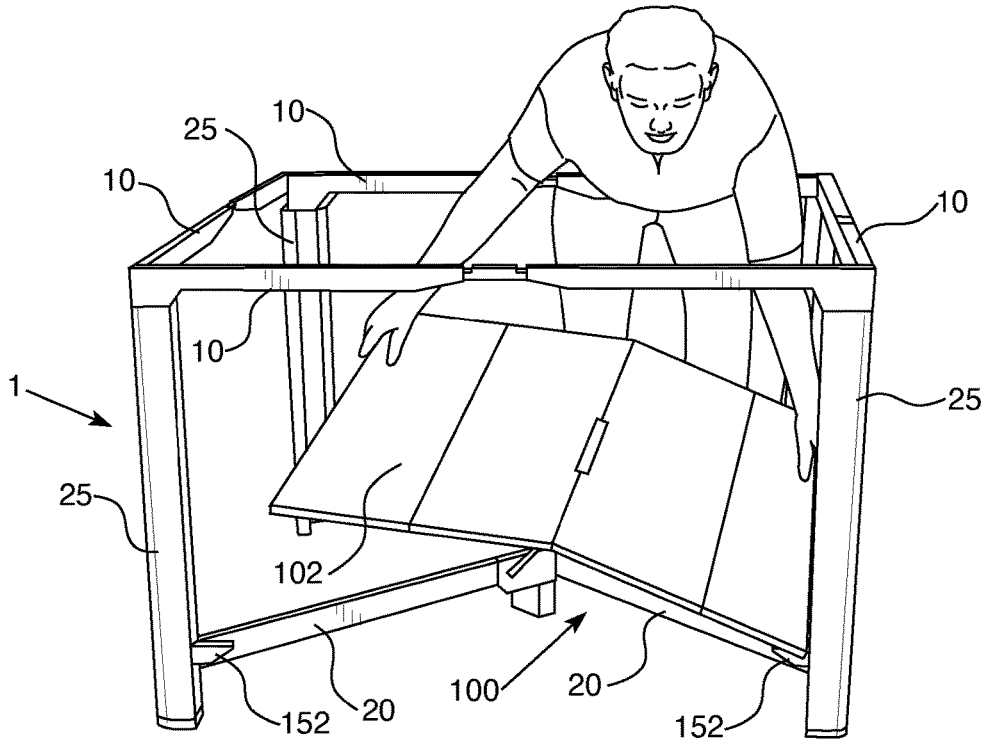
FIG. 9 illustrates a method of inserting one edge of the mattress base of FIG. 8 above two brackets and under two corner stops on a play yard according to one embodiment of the present invention.
Figure 10:
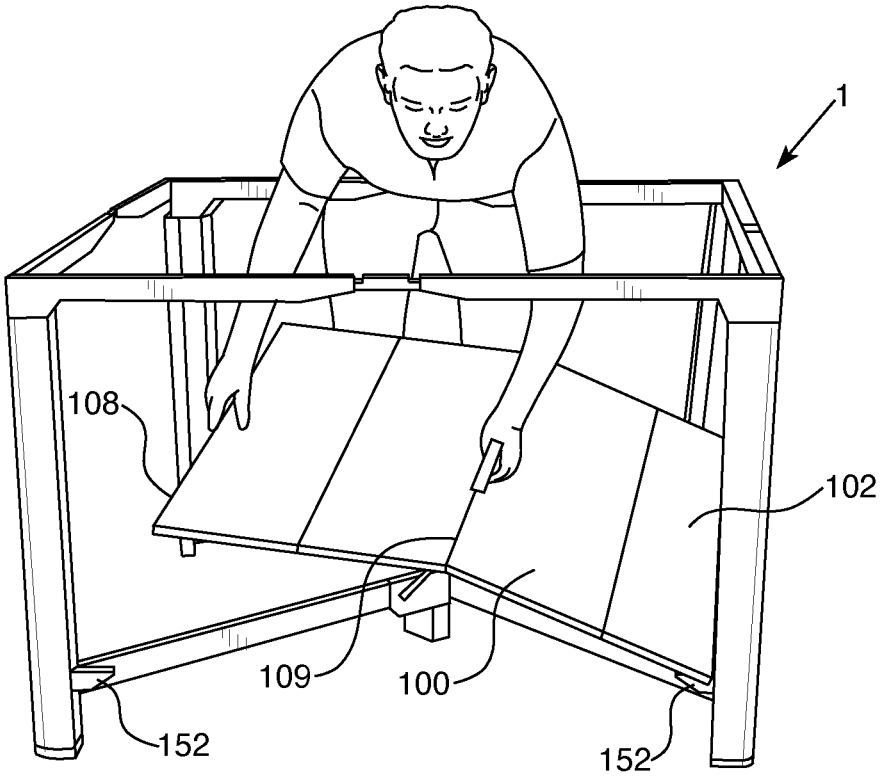
FIG. 10 illustrates a further step of the installation method shown in FIG. 9.
Figure 11:
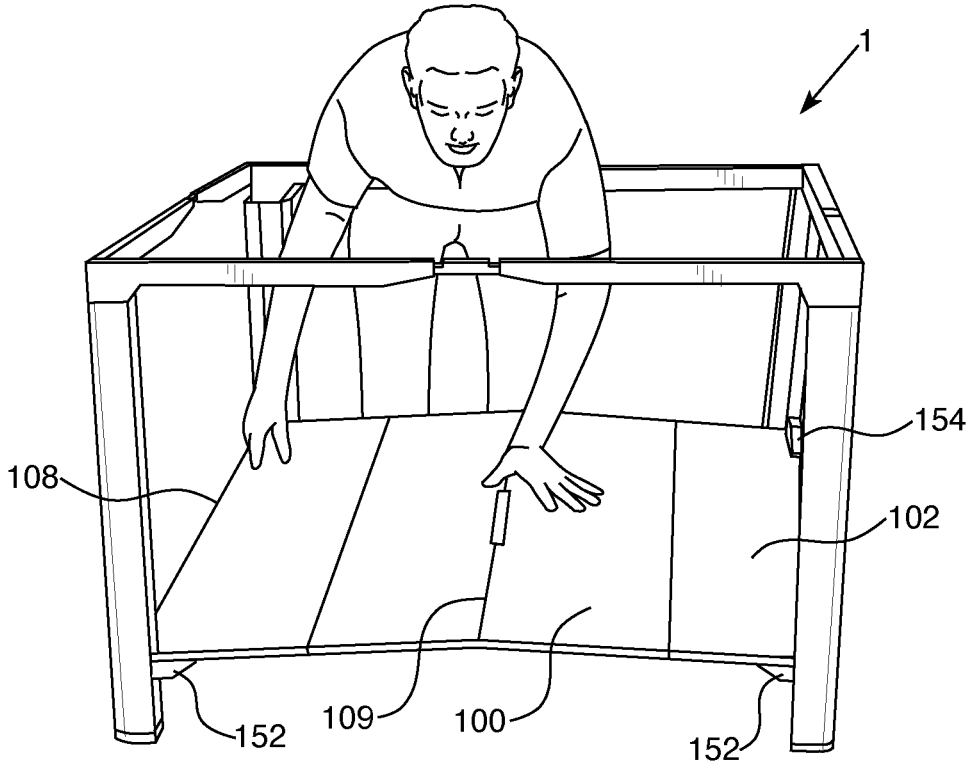
FIG. 11 illustrates the insertion of a second edge of the mattress of FIGS. 9 and 10 under the remaining two opposite corner stops.

Referring to FIGS. 1 and 8 through 13, the invention encompasses a variety of embodiments of a novel mattress base 100 for a child's play yard 1, a combination of a mattress base 100 with at least one securing mechanism 150, a folding play yard 1 with at least one securing mechanism 150, such as brackets 152 and stops 154, to secure a mattress base 100 in an open play yard 1, a method of installing a mattress base 100 in a play yard 1, and the use of stops 154 to secure any mattress to any play yard 1. As shown in FIGS. 1 and 7 through 13, the mattress base 100 according to some embodiments of the invention is comprised of a plurality of panels 110 that are pivotably connected to one another and cover the floor 15 of a play yard 1 to support a child who is inside of the play yard 1 or secured above the floor 15 of a play yard 1 to support a baby in a bassinet-type arrangement. The mattress base 100 can be comprised of any number of panels 110 that enable the mattress base 100 to fold to a smaller size for packing, shipping, transportation and/or storage, etc. (see FIG. 17) and to unfold to fully cover the play yard 1 floor 15. As shown in FIGS. 1 and 6 through 13, one embodiment of the mattress base 100 of the present invention is configured to fold or bend sufficiently to enable it, upon installation into an open play yard 1, to have the mattress base 100 edges 108 or corners 106 insert securely within the securing mechanisms 150 (such as sitting between supporting brackets 152 and stops 154 mounted at each corner post 25 of the play yard 1). Finally, the configuration of panels 110 is such that, when unfolding the mattress base 100 with the upper side 102 facing the user and the lower side 104 facing the material insert floor 15 of the play yard 1, at least one of the junctures between adjacent panels 110 opens or unfolds towards the floor 15 of the play yard 1 (creating an inverted V-shape as shown in FIGS. 9 through 11) instead of unfolding towards the user. For one embodiment of the present invention, at least two of the plurality of panels 110 adjacent to the perimeter of the play yard 1 unfold in an inverted-V shape towards the play yard floor 15. For a preferred embodiment of the present invention, wherein the only securing mechanisms 150 that hold the mattress base 100 in place are combinations or pairs of supporting brackets 152 and upwardly restraining stops 154 associated with each of at least two diagonally opposite corner posts 25 of the play yard 1, all of the junctures between panels 110 open to create inverted V-shapes when unfolded with the upper side 102 facing the user and the lower side 104 facing the floor 15 of open play yard 1 as shown in FIGS. 7, 9 and 10.

As shown in FIG. 1, the corners 106 of the mattress base 100 can have different shapes depending upon the shape of the corner posts 25 that the mattress corners 106 abut in an open play yard 1. The design and configuration of certain types of play yard corner posts 25 will dictate that the mattress base 100 have traditional 90-degree corners 106. However, the design and configuration of other types of corner posts 25 may dictate that the corners 106 of the mattress base 100 have cut outs 107, be rounded or angled, or be designed and configured to accommodate a corner post 25 whose shape is not 90-degrees (as shown by the cut outs 107 in FIG. 1 or the angled corner 106 of FIG. 16). As a further alternative, the design and configuration of some play yards 1 include the use of a mattress base 100 that would need the cut outs 107 at the corners 106 to go around or surround at least a portion of the corner posts 25. An example of one type of cut out 107 according to one embodiment of the present invention is shown in FIG. 1. The present invention includes corners 106 of any shape and design necessary to accommodate the structure of the surrounding play yard 1 including the corner posts 25.

As shown in FIGS. 1 through 14, some embodiments of the present invention encompass the use of at least two combinations of a bracket 152 and a stop 154 on each of at least two corner posts 25 of a play yard 1 (see, for example, the bracket 152 and stop 154 combinations on the corner posts 25 in FIGS. 1, 6, 7 and 8). If only two combinations of a bracket 152 and a stop 154 are used, each combination is placed on diagonally opposite corner posts 25 (on a rectangular, four-cornered play yard 1). Additional combinations of bracket 152 and stop 154 can be placed on additional play yard corner posts 25 or any other appropriate structures of a play yard 1 to accomplish the goals of the present invention. A preferred embodiment of the present invention utilizes four bracket 152 and stop 154 combinations, with each combination associated with one of the four corner posts 25 of a play yard 1. This embodiment of the corner brackets 152 is shown partially in FIGS. 1 and 6 through 12.

As shown in FIGS. 1 through 12, the brackets 152 are designed to provide additional support for the edges 108 or corners 106 of the mattress base 100 usually at or near the corner posts 25 and to create, when coupled with a stop 154, a space in which to insert the edge 108 or corner 106 of a mattress base 100 to secure the mattress base 100 from being lifted by a child in the play yard 1. The brackets 152 can have a wide variety of sizes, shapes, designs, etc. However, each bracket 152 should securely attach to a corner post 25 (or another play yard 1 structure) and extend to provide support to the edge 108 or corner 106 of the mattress base 100 and aid in securing the mattress base 100 when coupled with a stop 154. As shown in the embodiment in FIGS. 1, 2 and 7 through 15, the brackets 152 can be mounted facing outward along the outer sides of the play yard 1.

As shown in FIGS. 1 and 4 through 13, the present invention also comprises the use of stops 154, which sit above an inserted mattress base 100 and prevent the inserted mattress base 100 from being lifted by a child in the play yard 1. The stops 154 can have a wide variety of sizes, shapes, designs, etc. However, in order to prevent a child in the play yard 1 from getting their fingers underneath the mattress base 100 and lifting it upwards each stop 154 should be securely attached to a corner post 25 of play yard 1 or other play yard structure in such a location so as to be adjacent to the edge 108 or corner 106 of mattress base 100 and also be located just far enough above the play yard floor 15 to allow for the insertion of the mattress base 100 underneath the stop 154, which will be close to the upper surface 102 of the mattress base 100 after the mattress base 100 has been inserted into the open play yard 1. Alternative embodiments of the present invention have stops 154 located on and secured to the material insert 5 or any railings or other firm structures along or adjacent to the perimeter of the play yard floor 15. Stops 154 hold the inserted edges 108 and/or corners 106 of mattress base 100 in place and prevent a child from lifting the edges 108 or corners 106 far enough for an entrapment or suffocation risk to be created between the lifted mattress base 100 and the floor 15 or side 30 of the play yard 1. As shown in the embodiment in FIG. 1, the stops 154 can be mounted along the shorter sides 30 of the play yard 1. In other embodiments, such as the embodiment shown in FIG. 13, the stops 154 can be located along the longer sides 30 of the play yard 1. Similarly, each bracket 152 can be located on the same side of a corner post 25 as the corresponding stop 154 (above and below each other) so that the mattress base 100 is contained by the stop 154 located above the mattress base 100 and support by the bracket 152 below the mattress base 100 at each corner post 25. Alternatively, as shown in FIGS. 1 and 4 through 12, the brackets 152 and stops 154 can be mounted on alternative sides of each corner post 25. While the description herein contemplates the use of "combinations" or "pairs" of brackets 152 and stops 154 (or one-piece stop and bracket devices 156), other embodiments of the present invention can have an odd number of unmatched brackets 152 and stops 154 or, as explained more fully herein, just stops 154.

Figure 18:
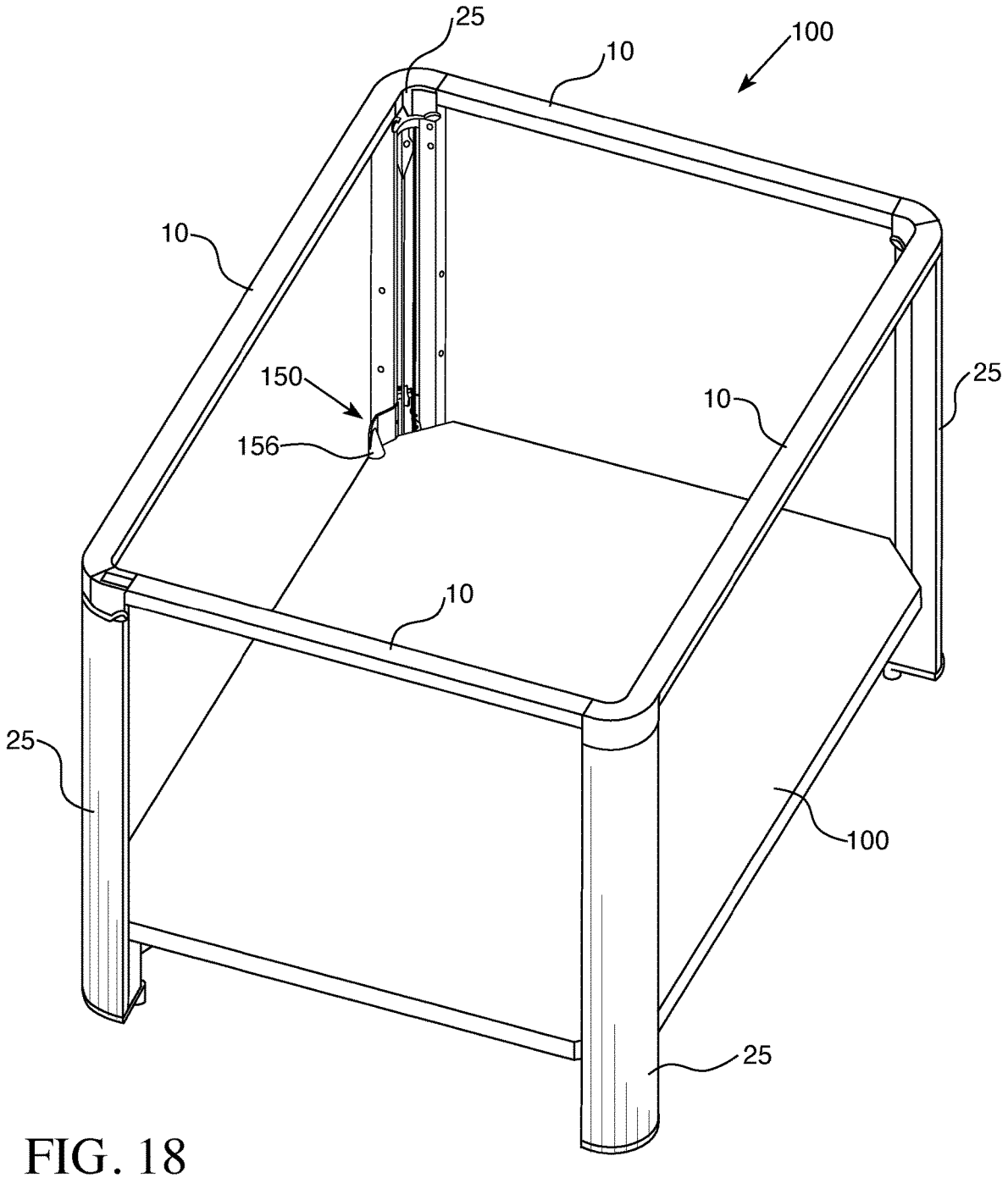
FIG. 18 illustrates a play yarding having one embodiment of a one-piece stop and bracket according to the present invention attached to a corner post.

One of the preferred embodiments of the present invention has the stops 154 (or one-piece stop and brackets 156 discussed below) mounted along the long side of the play yard 1 (as shown in FIG. 18). The advantage of this location is that it makes it more difficult for a child to pull the mattress 100 out from under the stops 154 when pulling away from the short side of the play yard 1. This results in several cost savings when manufacturing mattresses 100 and play yards 1 according to the present invention. First, one or more one-way metal hinges are no longer needed to prevent the rotation of the mattress panels 110. This "hinge" or pivot structure for the panels can be accomplished solely through the material or fabric cover 170 (discussed more fully below). This results in a cost savings in the manufacture of devices according to the present invention.

Figure 19A:
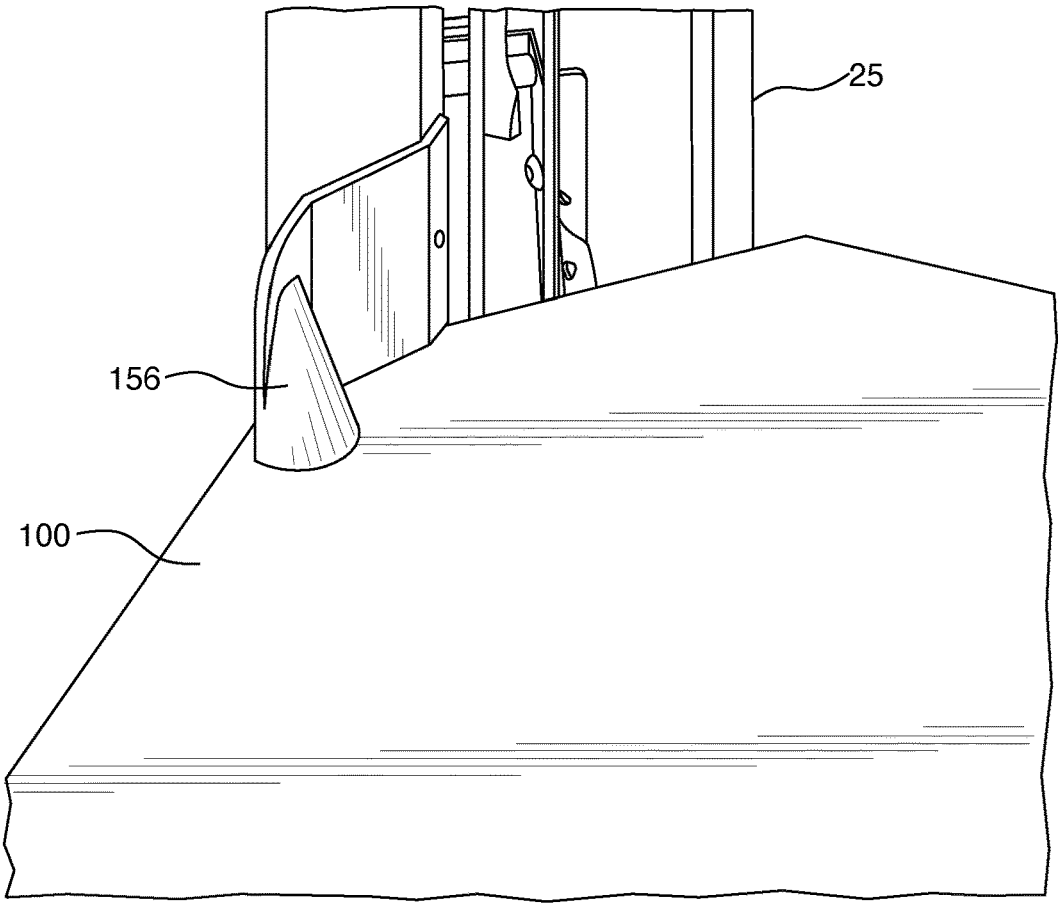
FIGS. 19A and 19B are close-up views of one embodiment of a one-piece stop and bracket according to the present invention.
Figure 19B:
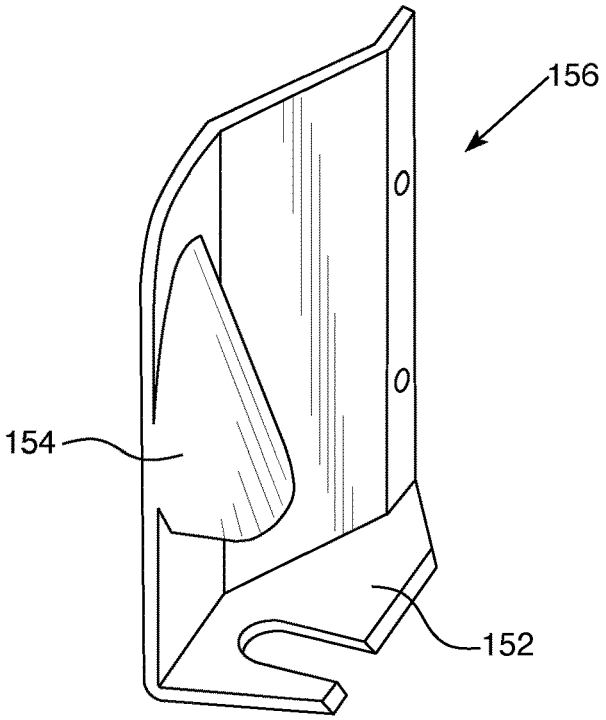

An alternative embodiment of the present invention is a one-piece stop and bracket 156 as shown in FIGS. 19A and 19B. Any of the above-described configurations for individual stops 154 and individual brackets 152 can be incorporated into a one-piece stop and bracket 156 to accomplish the same goals of supporting the mattress 100 while preventing a child from lifting the mattress 100 high enough to create an entrapment hazard. FIG. 19B illustrates one embodiment of a one-piece stop and bracket 156 having a protruding stop 154 located above a bracket 152 structure to create a space into which a mattress 100 can be inserted (as shown in FIG. 19A).

Various embodiments of the one-piece stop and bracket 156 and individual stops 154 of the present invention can be made of plastic or metal (but preferably plastic) that is configured to provide a flexible or spring-like engagement with the mattress 100 such that when the mattress 100 is pressed down into the play yard 1, the mattress 100 snaps or pops underneath the stops 154. This springy engagement is accomplished by configuring the stops 154 out of a material that can take some degree of pressure and bounce back without cracking and designing the shape of the stops 154 so that they have curved edges (as shown in FIGS. 19A and 19B) that facilitate the mattress 100 sliding over and under the stops 154 during installation and enable the removal of the mattress 100 by pulling up on the mattress 100 such that the mattress 100 snaps out of engagement with the stops 154.

For any play yard 1 design, configuration or structure, an appropriate number of brackets 152 should be located along the periphery of the play yard 1 to provide support for the edges 108 and/or corners 106 of the mattress base 100. Additionally, for any play yard 1 design and configuration, an appropriate number of stops 154 should be used to prevent a child from lifting the mattress base 100 while inside of the play yard 1. The number of stops 154 needed will depend upon a number of factors including but not limited to the size of the mattress base 100, the material from which the mattress base 100 is made and/or the anticipated age or strength of the child intended for the play yard 1 and the location of the stops 154. In most embodiments of the present invention, the brackets 152 and stops 154 will be in pairs and located within the vicinity of each other; however, it will be obvious to one skilled in the art that various embodiments of the present invention can include the use of different numbers of brackets 152 from the number of stops 154 and that those brackets 152 and stops 154 do not necessarily have to located in pairs or in proximity to each other to provide for the secure installation of a mattress base 100 without the need to secure the mattress base 100 to the underside of the play yard 1.

The above discussion of brackets 152 and stops 154 describes embodiments wherein the brackets 152 and the stops 154 are secured to or are part of the corner posts 25 as shown. For those embodiments where the bracket 152 and stop 154 combinations on the corner posts 25 and the play yard 1 has a material insert 5, the insert 5 can be designed and configured to accommodate the brackets 152 and stops 154. However, the present invention also encompasses alternative structures, designs and configurations that accomplish this dual purpose of providing additional support for the mattress base 100 while trapping the corners 106 or edges 108 of the mattress base 100 to prevent a child from lifting the mattress base 100. One alternative structure comprises having the stops 154 and brackets 152 attached to the material insert 5 that forms the sides 30 and the floor 15 of the play yard 1. Stops 154 and/or brackets 152 can be attached to or integral to the material insert 5 near the corners 106 or edges 108 of the material insert 5 such that, when the mattress base 100 is inserted into the open play yard 1, the edges 108 or corners 106 of mattress base 100 are inserted into the spaces created by the brackets 152 and/or stops 154 either or both of which are attached to the material insert 5.

An additional alternative embodiment not shown in the Figures comprises designing and configuring the material insert 5 so that the insert 5 has pockets 7 to receive the corners 106 and/or edges 108 of the mattress base 100. Pockets 7 in the material insert 5 can be used alone or combined with brackets 152 and employed to limit a child's ability to lift the corners 106 and edges 108 of the mattress base 100. When any edge securing structure 150 is combined with the use of a mattress base 100 that is hinged to open in an inverted V-shape away from the user (as shown in FIGS. 9 through 11), the combination of the securing structure 150 and the hinged mattress base 100 prevents a child in the play yard 1 from lifting the edges 108 of the mattress base 100 upon proper installation of the mattress base 100.

The combined design and configuration of the mattress base 100, the stops 154 and the brackets 152 (or alternative edge securing mechanisms 150) solves multiple problems. First, a mattress 100 when installed with securing mechanisms 150 of these designs is secure against being lifted by a child sufficiently to create an entrapment or suffocation hazard and, more importantly, does not require any additional steps to secure the mattress base 100 (such as securing straps to the underside of the play yard 1). Second, the mattress base 100 and securing mechanisms 150 of the present invention create an installation method and set-up that is significantly more intuitive than what is currently on the market. Achieving a safe play yard 1 is no longer dependent upon the user having read the manual or watched a video to figure out how to secure the mattress base 100 to the play yard 1. The act of installing the mattress base 100 into the play yard 1 (and, at the same time, under the stops 154 and over the brackets 152), whereby the mattress 100 sit relatively flat to the floor 15), accomplishes the step of safely securing the play yard mattress 100. Finally, a mattress base 100 and securing mechanisms 150 according to the designs and configuration discussed above provide a snugger fit between the mattress base 100 and the surrounding structure of play yard structure 1 with fewer gaps than exist with currently available play yard and mattress combinations.

A preferred embodiment of both the devices/structures and an installation method of the present invention is illustrated in FIGS. 2 through 12. FIGS. 2 through 6 illustrate an example of the opening of a folding child's play yard 1 for use with the present invention. As can be seen in FIGS. 4 through 12, one preferred embodiment of the play yard 1 has bracket 152 and stop 154 combinations located on all four corner posts 25 of a rectangular play yard 1 to allow for the insertion of a mattress base 100 under the stops 154 and above the brackets 152 to hold the installed mattress base 100 securely in place.

The mattress base 100 according to the presentation invention is comprised of a plurality of pivotably connected panels 110 numbered, sized and shaped to snuggly cover the horizontal floor surface 15 of a play yard 1. A preferred embodiment of the mattress base 100 (again shown in FIGS. 1 and 8 through 12) is comprised of four pivotably connected panels 110 having three panel junctures 120 (shown in FIG. 1). It will be obvious to one skilled in the art that there is a wide variety in the number of panels 110 that can be used depending upon the size and shape of the play yard 1 and the mattress base 100; the shipping, packaging, transportation, and storage needs/desires for the mattress base 100; the materials from which the mattress base 100 is constructed; the manufacturing needs; and the requirements for the mattress base 100, without limitation. In this embodiment, mattress base 100 is stored by folding the four pivotably connected panels 110 of base 100 along three panel junctions 120 to achieve a smaller closed dimension and to facilitate easy transport and storage of the closed or unused mattress base 100. This same mattress base 100 comprised of four panels 110 (and three pivoting connections 120) can be folded around a closed play yard 1 for easy transportation and storage.

Figure 12:
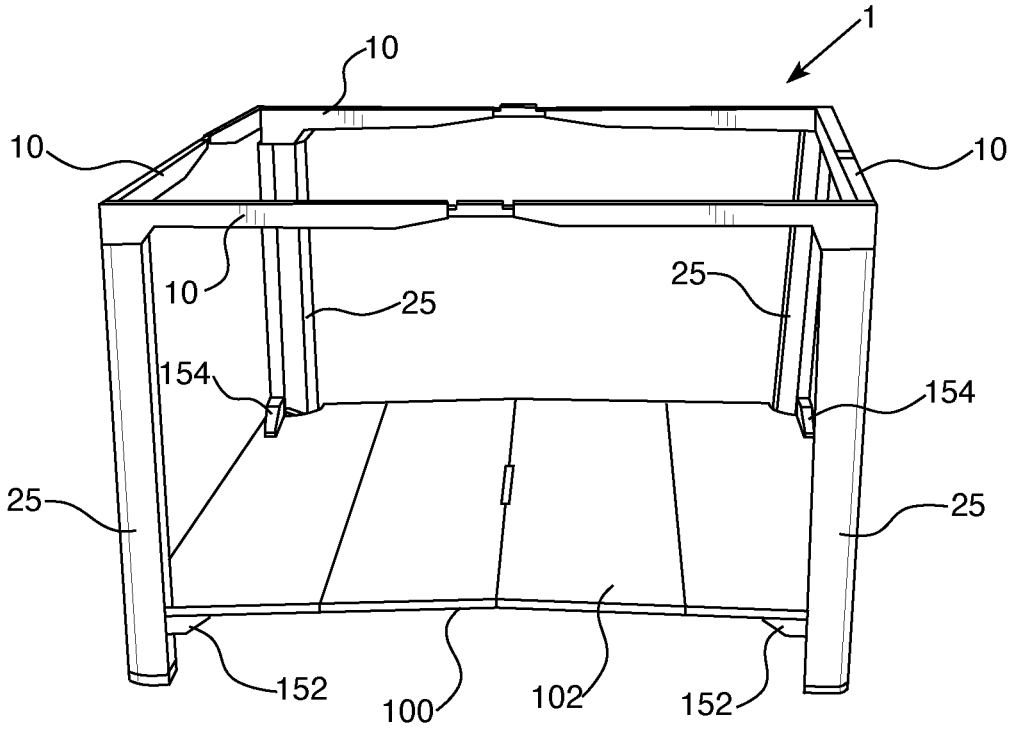
FIG. 12 shows the fully deployed mattress of FIGS. 7 through 11.

As shown in FIGS. 7 through 9, the mattress base 100 according to a preferred embodiment of the present invention is unfolded before or during installation. The installation method of the present invention can be accomplished in one of two ways. First, as shown in FIGS. 9 through 10, after unfolding all or part of the mattress base 100, one edge 108 of the mattress base 100 is inserted under its corresponding stops 154. Then, as shown in FIG. 11, the second (and opposing) edge 108 of the mattress base 100 is inserted under its corresponding stops 154. Alternatively, the mattress base 100 can be unfolded partially but retain a temporary fold in the center 109 (to create an inverted V-shape) and be installed into the play yard 1 by placing both opposing edges 108 at or near their corresponding stops 154 and then pushing, dropping or setting the center 109 of the mattress base 100 down to further extend the mattress base 100 under the stops 154. A fully installed mattress 100 is shown in FIG. 12.

It will be obvious to one skilled in art that there are numerous different ways and different orders of steps that can successfully accomplish installing the mattress base 100 into the play yard 1. The wide variety of acceptable installation steps is one of the advantages of the present invention because it generally will be intuitive to the user, when first seeing both the mattress base 100 and the open play yard 1 with corner stops 154 and brackets 152, that the ultimate goal is to put the mattress 100 into the play yard 1 and under the stops 154 and above the brackets 152. This observation and the steps that need to be taken to accomplish installation are dictated by the structure of the mattress 100 and the structure and location of the stops 154 and brackets 152 and often will become apparent to the user without the user needing to read a detailed instruction manual or watch a video. In addition, and as discussed above, a safe and secure mattress base 100 installation is obtained without relying upon additional steps to secure the mattress base 100 to the underside of the play yard 1.

Figure 13:
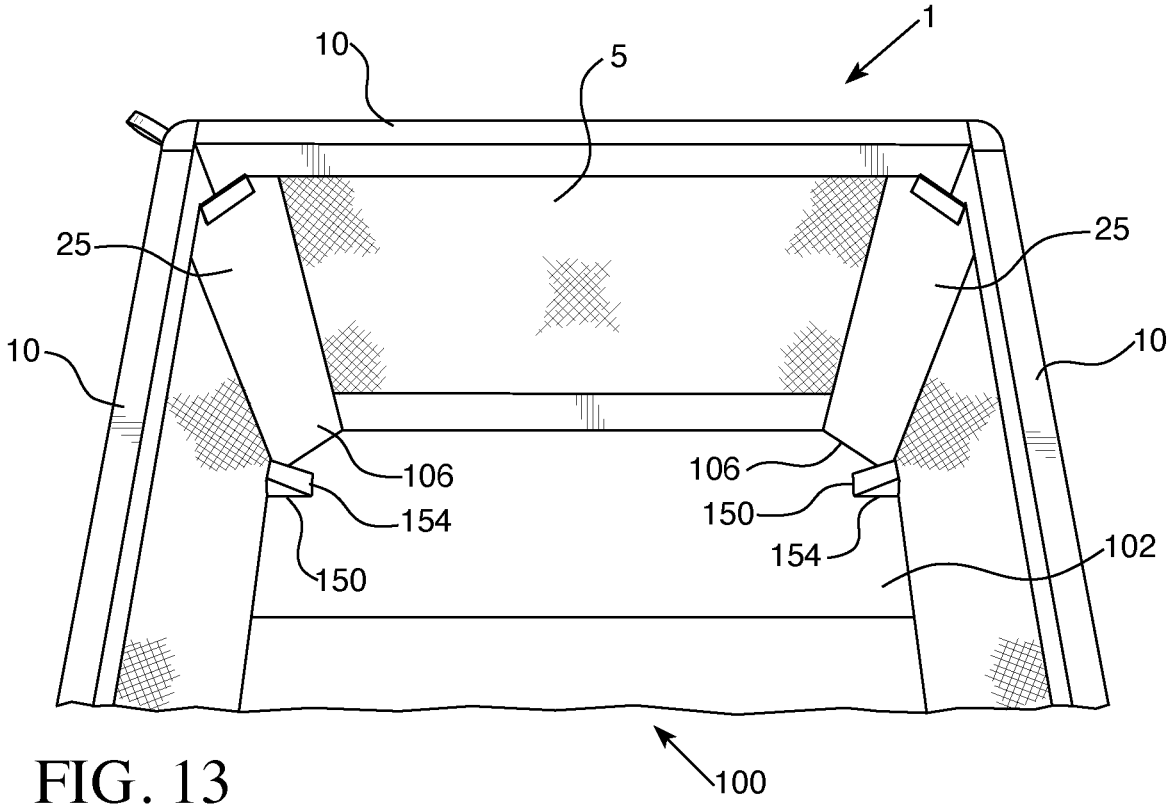
FIG. 13 illustrates an alternative embodiment of the present invention's mattress stops with the stops located above the two longer sides of the mattress.

The present invention also encompasses a folding mattress base 100 comprised of pivotably attached panels 110 and at least one securing mechanism 150, such as a set of corner brackets 152 and stops 154 or a one-piece stop and bracket 156 to secure that mattress base 100 near a play yard's floor 15 (as shown in FIGS. 1 through 13). An alternative embodiment of the present invention is directed to a folding play yard 1 having mattress base 100 securing mechanisms 150, including but not limited to bracket 152 and stop 154 combinations or a one-piece stop and bracket 156 attached to at least two of its corner posts 25, and a folding mattress base 100 comprised of pivotably attached panels 110 and designed to be installed under the stops 154 (FIGS. 12 and 13). Both embodiments of the present invention can be designed and configured according to all of the variations described herein.

There are numerous materials from which the components of the present invention can be made to accomplish the goals of the invention. The mattress base 100 can be comprised of one material or layers of different materials. The mattress base 100 needs to be made of at least one material that is sufficiently strong to create a play surface that will support a child of an appropriate age and sufficiently stiff to withstand a child's attempt to bend or lift the edges 108 of the mattress base 100. A common limitation for play yards 1 is that they support a child up to 30 pounds. Some nonlimiting examples of materials that can be used for the mattress base 100 include rigid boards of a variety materials, corrugated plastic, honeycomb board, plastic, MDF (medium density fiberboard), wood, and other similar materials. Depending upon the material from which the mattress base 100 is made, certain embodiments of the present invention are designed with a different material around the edges 108 of the mattress base 100 to create a smoother edge 108 and/or to provide a stronger or stiffer edge 108. One such example is a "U"-shape edge (turned sideways) made from aluminum extrusion or bent steel that is pressed over the outside of the board element.

In other embodiments of the present invention, the mattress base 100 made be made of multiple layers of different materials. A layered structure may be used to create stronger or firmer panels 110 or the layers may be used to create a softer play surface 200 on top of a firmer base layer. One nonlimiting example includes layering a sufficiently supportive and stiff base layer under a cushioning layer 200 (such as foam) and then wrapping both layers in a softer material cover 170 layer or a layer of an easily wipeable material. For embodiments of the present invention utilizing a mattress base 100 that is made of non-cushioning materials, an optional removable soft and cushioning mattress pad can be used on top of the mattress base 100 so long as the pad is then secured to the mattress base 100 to prevent a child from lifting the mattress 100.

Figure 22:
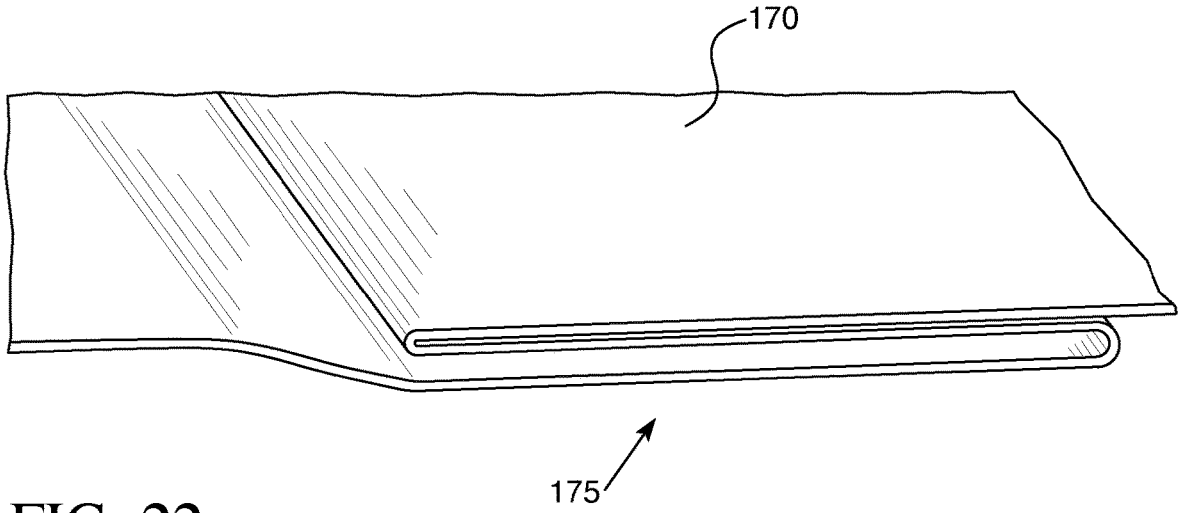
FIG. 22 is a close-up view of the folded material cover that can be used at panel junctures in one embodiment of the present invention.

The mattress base panels 110 are pivotably movable relative to one another, with such movement accomplished by any form of known structure for pivoting movement. Nonlimiting examples of structures that accomplish the dual goal of creating a foldable mattress base 100 while resisting a child's attempts to lift the edges 108 of the mattress base 100 include a wide variety of hinges, including but not limited to piano style hinges with a metal pin and molded living hinges. An alternative embodiment is a plastic strip that bends at the juncture between the panels 110 such that the mattress base 100 can fold and the bracket 152 and stop 154 structures achieve the goal of securing the edges 108 of the mattress base 100. Another embodiment is configuring folds 175 in the material cover 170 of the mattress 100 as discussed more fully herein and as shown in FIG. 22.

The mattress base 100 of the present invention can be designed to be used with or without a soft cover or material cover 170. The cover 170 can be designed and configured to be a permanent part of the mattress 100 or the cover 170 can be designed to be removable. In a preferred embodiment of the present invention, a mattress cover 170 is designed to accommodate the pivoting and folding junctures of the mattress panels 110. Additionally, for embodiments that require it, covers 170 for the present invention are designed to accommodate the corner brackets 152 by either being designed and configured to cover the brackets 152 or include cut outs through which the brackets 152 protrude.

Finally, mattress base 100 can be suspended above the play yard floor 15 to create a shallower bassinet structure for an infant. It will be obvious to one skilled in the art that the mattress base 100 of the present invention also can be suspended or supported above the floor 15 by locating brackets 152 closer to the play yard upper rails 10 to create the support surface of a bassinet structure. Because the bassinet structure is intended to be used with infants, who are not able yet to sit up on their own, there is not a concern about preventing the infant from lifting the corners 106 or edges 108 of the mattress base 100. Therefore, alternative embodiments of the mattress base 100 of the present invention adapted for use at a bassinet height can be combined with a wide variety of existing technologies to convert a standard play yard 1 into a bassinet and does not necessarily require the use of stops 154 or a similar securing mechanism 150.

The mattress 100 of the present invention can be designed to be any size or shape, but for most currently available play yards 1 it will unfold to be square or rectangular in shape.

An alternative embodiment of the present invention comprises the use of a plurality of stops 154 with any play yard 1 to prevent almost any style of mattress base 100 from being lifted by a child. As described previously here, strategically located and sized stops 154 secure the mattress base 100 within the play yard 1 without the need for straps and snaps, etc. underneath the play yard 1. In a preferred embodiment, at least four stops 154 are used within a play yard 1, one near each corner of the play yard 1. One illustration of this embodiment is shown in FIG. 13. In a rectangular play yard 1, four stops 154 are located along the longer two sides of the mattress base 100 or of the play yard 1. In this embodiment, the stops 154 are not in the corners of the play yard 1 but are a few inches away from the corners of the play yard 1 (see FIG. 13). The location of the stops 154 of this embodiment of the present invention, makes it much harder for a child to lift the mattress base 100 high enough to create an entrapment of suffocation hazard because the child would have to pull the mattress base 100 several inches towards the center of the play yard 1 and slide the mattress base 100 out from under the stops 154. It will be understood by one skilled in the art that the exact location of the stops 154 and the dimensions of the stops 154 will vary according to the design and size of the play yard 1 and the design, size, and structure of the mattress base 100. However, the present invention encompasses the use of any structure similar to the stops 154 disclosed herein that are located within a play yard 1 and close to the upper side 102 of a mattress base 100 to secure mattress base 100 against being lifted by a child in the play yard 1.

In order for stops 154 of the present invention to secure a mattress base 100 against being lifted by a child, the mattress base 100 needs to have some structure to it. The mattress base 100 cannot be an entirely soft, pillowy structure. For a mattress base 100 made of panels 110, the mattress base 100 must have some structure or firmness in the mattress panels 110 to prevent the panels 110 from overlapping each other and pulling out from under the stops 154.

Figure 15:
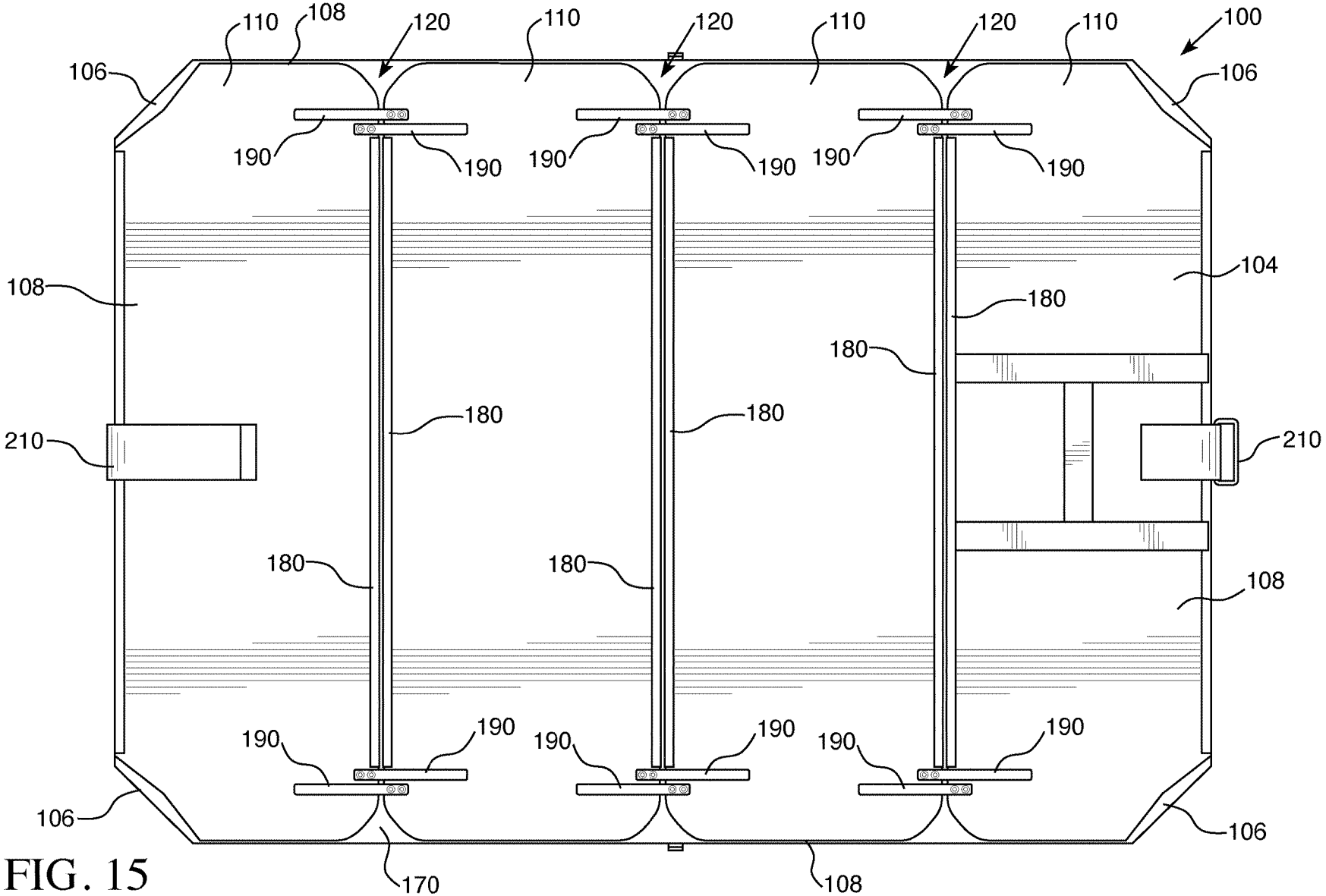
FIG. 15 illustrates the lower side of an alternative embodiment of a mattress according to the present invention incorporating panel edge covers and anti-slip strips.
Figure 16:
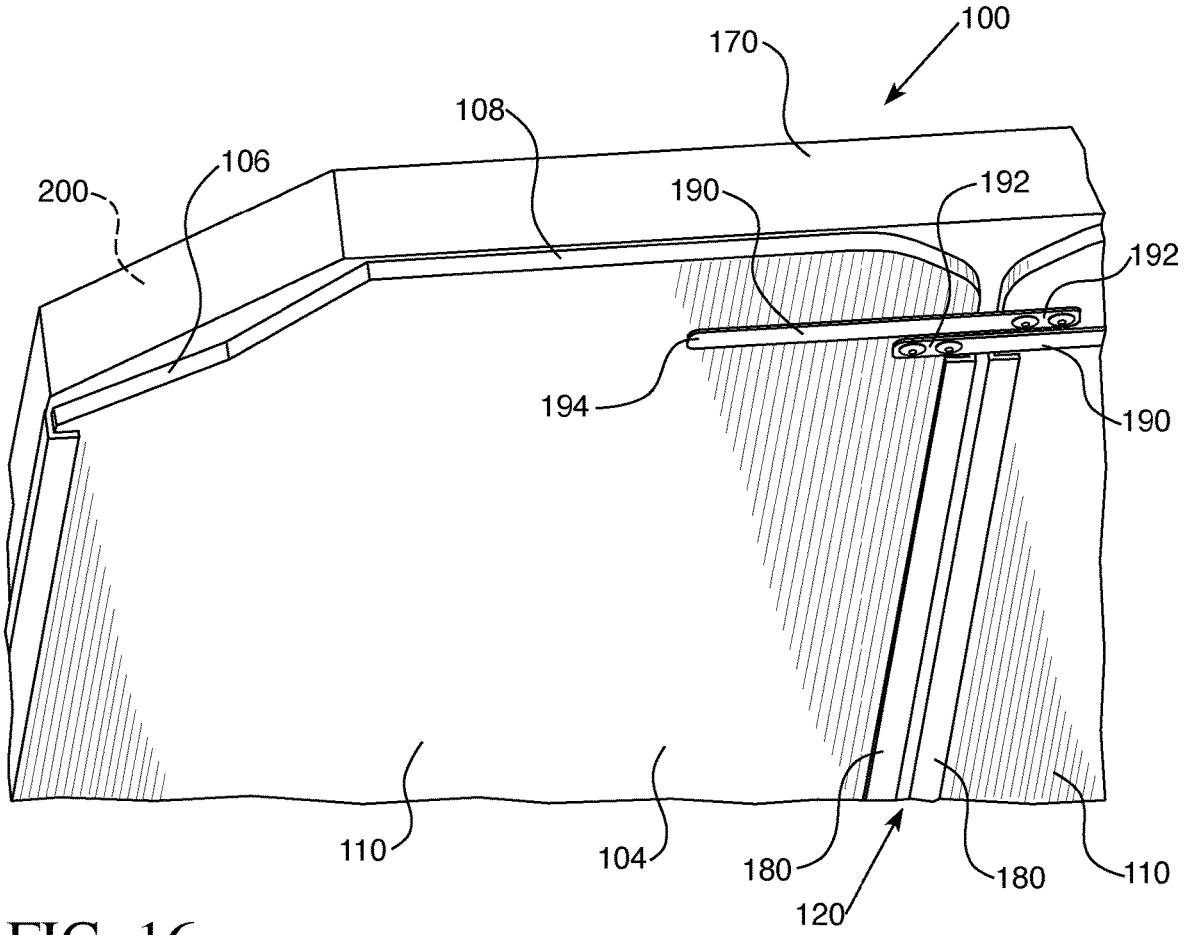
FIG. 16 is a close-up perspective view of a corner of the mattress shown in FIG. 15.
Figure 17:
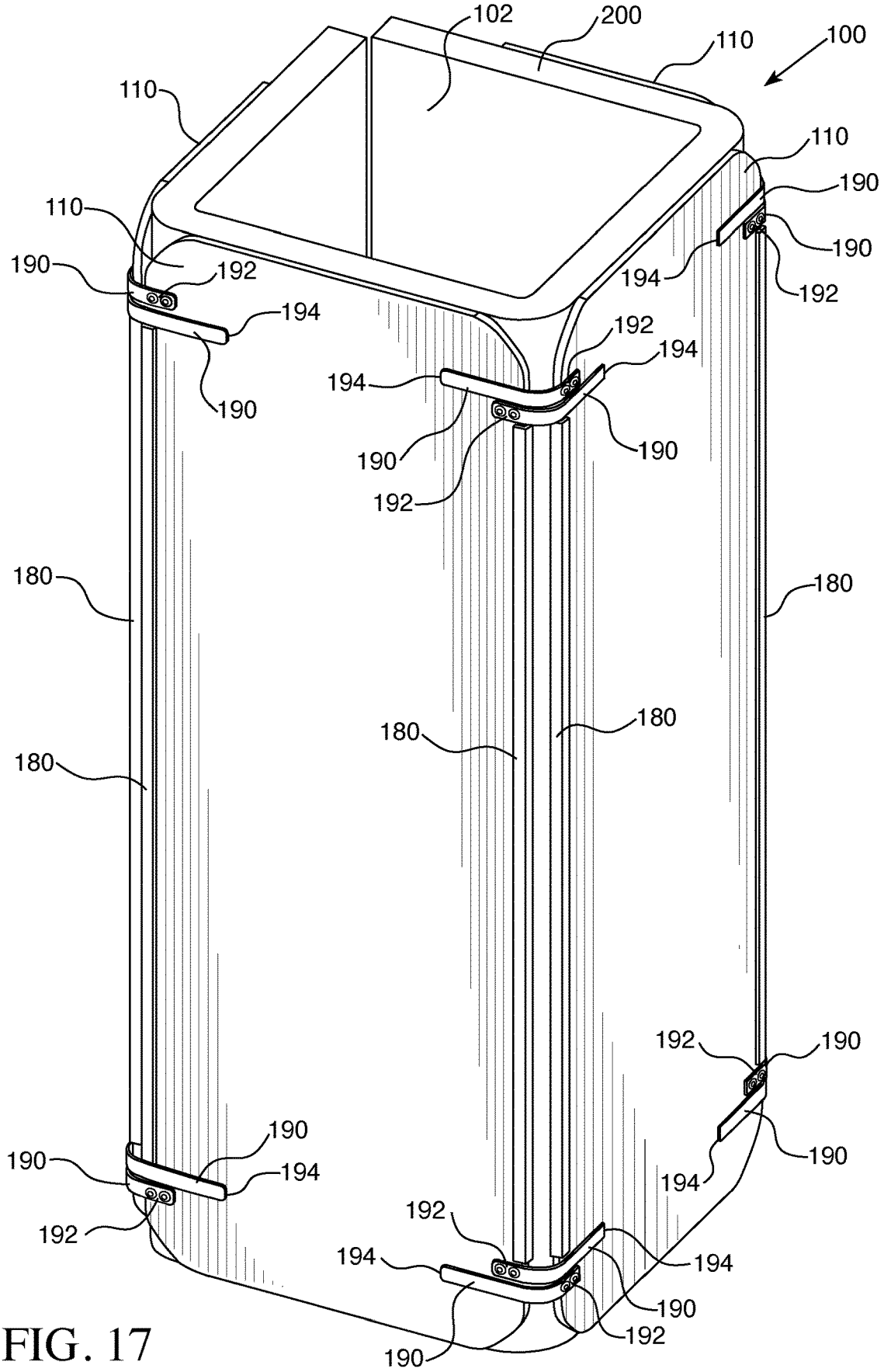
FIG. 17 shows the mattress of FIG. 15 in the closed arrangement for transport or storage around a closed play yard.

FIG. 15 through 17 illustrate an alternative embodiment of a mattress 100 according to the present invention. FIG. 15 shows the lower side 104 of the mattress 100. This embodiment is comprised of at least two, but preferably four, panels 110. In this embodiment, the panels 110 are not connected directly to one another. Instead, the mattress cover 170 holds the panels 110, in place with respect to one another, along with any cushion or foam pad 200 that is on top of the panels 110. FIG. 16 shows the details of this arrangement. A plurality of anti-slip strips 190 attached to the panels 110 prevent the panels 110 from slipping or sliding up and over one another (see FIGS. 15 and 16).

The anti-slip strips 190 are pieces of flexible material (usually plastic, but optionally, metal, nylon, or other flexible materials). Each anti-slip strip 190 is attached at one of its ends (the "attached end 192") to panel 110. The opposing end of each strap (the "unattached end 194") overlaps with the adjacent panel 110 by at least two-inches and by about three to four-inches in the preferred embodiment. The anti-slip strips 190, each with its attached end 192 and unattached end 194, are shown in FIGS. 15 through 17. Also in the alternative embodiment, there are two pairs of anti-slip strips 190 at each panel junction 120 as shown in FIGS. 15 and 17. The anti-slip strips 190 prevent the panels 110 from overlapping with one another within the material cover 170. By making the anti-slip strips 190 out of a flexible material, the strips 190 can bend underneath the cover 170 when the mattress 100 is folded up, as shown in FIG. 17. The material cover 170 will hold the unattached end 194 of each strip 190 close to the panel 110 in the folded position.

These anti-slip strips 190 have several advantages over other technologies for securing panels 110 within a mattress 100. First, the strips 190 eliminate the need for hardware, such as hinges, to secure the panels 110 to one another to keep them in place. Second, the elimination of the need for hardware, results in the material cover 170 being the structure that keeps the panels 110 in place and order next to one another. This results in a cost savings in the manufacture of the mattress 100 of this embodiment. It also lessens the weight of the mattress 100 because there is less hardware in the mattress 100.

Also, in this alternative embodiment of this mattress 100 arrangement with anti-slip strips 190, the mattress cover 170 can be designed with folds 175 at the panel junctions 120 to accommodate the movement of the panels relative to one another when folding and unfolding the mattress. An example of such a fold 175 is shown in FIG. 22.

For certain embodiments of the present invention, edges covers 180 can be used at the panel junctures 120 as shown in FIGS. 15 through 17. These edge covers 180 can be configured to accomplish a number of goals including enabling adjacent panels 110 to move or fold relative to one another with greater ease, protecting adjacent panels 110 from wear and tear from rubbing against each other, or providing support for the panels 110 at these junctures 120.

Any of the embodiments of the present invention mattress 100 can be designed with an optional carrying handle 160 and an optional mattress closing mechanism 210. One embodiment of a carrying handle 160 is shown in FIG. 21.

Figure 20:
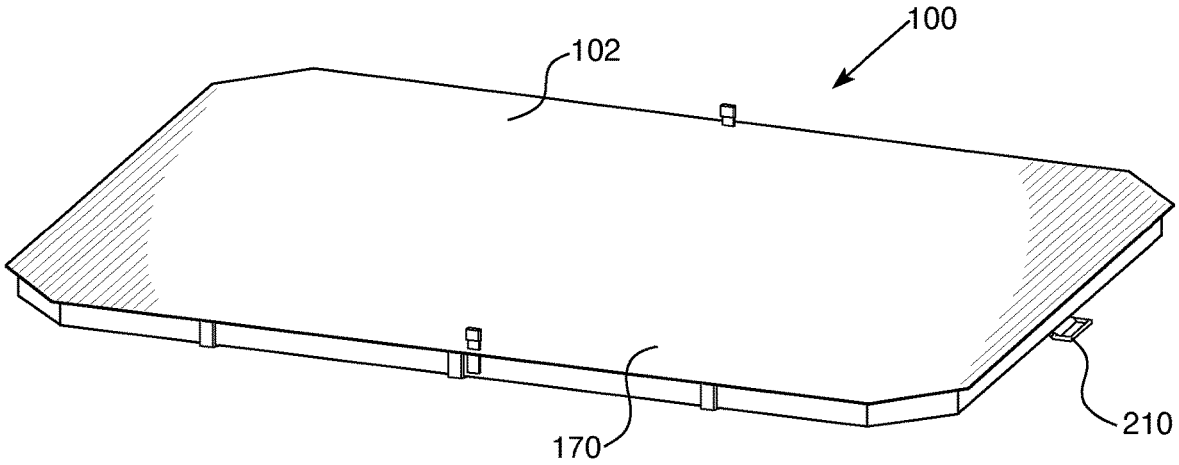
FIG. 20 shows the upper side of one embodiment of a mattress according to the present invention.
Figure 21:
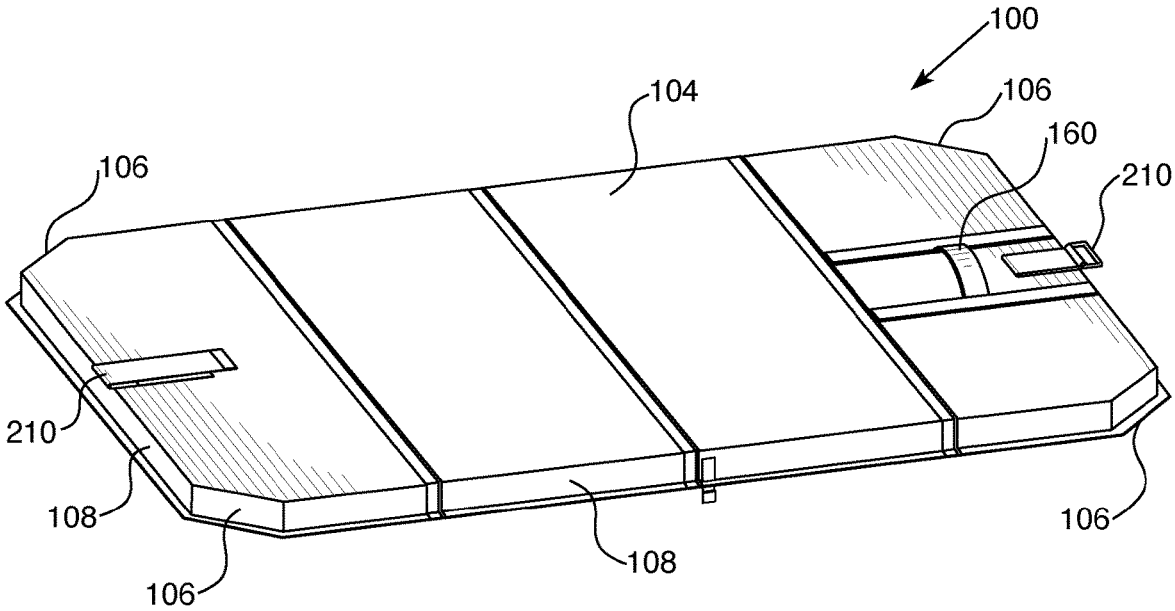
FIG. 21 shows the lower side of the mattress from FIG. 20 having one embodiment of a mattress closing mechanisms.

FIGS. 20 and 21 also illustrate an optional mattress closing mechanism 210 comprising a strap and buckle that would be used to secure the mattress 100 in the closed position shown in FIG. 17. The closed mattress 100, as shown in FIG. 17, can be wrapped around a closed play yard 1 for easy carrying and storage.

It will be obvious to those skilled in the art that the various attributes of the present invention can be combined in a variety of ways and all such combinations remain within the scope of the invention.

What is claimed is:

1. A mattress base securing system for securing a mattress base, having an upper side and a lower side with three or more corners, in a play yard having three or more corner posts that define an inside perimeter of the play yard and a floor, the mattress base securing system comprising:

A plurality of stops with each stop attached to one corner post and configured to move under downward pressure of the mattress base during installation and bounce back to an engaged position when the mattress base is installed, and at least one bracket wherein each of the at least one bracket is located below and in close proximity to the lower side of the mattress base and wherein each stop is located above and in close proximity to the upper side of the mattress base at a predetermined distance to accommodate and secure the mattress base following installation of the mattress base; and whereby at least one corner of the mattress base is configured to slide over and pop underneath one stop as the stop moves under downward pressure of the mattress base during installation and bounces back to an engaged position when the mattress base is installed and, after insertion, the at least one corner cannot be lifted upward.

2. The mattress base securing system of claim 1, wherein the mattress base has four corners and the play yard has four corner posts forming two pairs of diagonally opposite corner posts, comprising at least two brackets and wherein one stop and one bracket is secured to each corner post of one pair of diagonally opposite corner posts.

3. The mattress base securing system of claim 1, further comprising a mattress base having a plurality of pivotably connected panels wherein each panel is configured in size and shape so that the plurality of pivotably connected panels cover the play yard floor when the panels are fully unfolded, and wherein at least two adjacent panels adjacent to a perimeter of the play yard unfold in an inverted-V shape towards the floor of the structure.

4. The mattress base securing system of claim 3, further comprising a plurality of hinges that connect the plurality of panels to one another.

5. The mattress base securing system of claim 3, wherein each panel is comprised of at least one layer of a rigid material.

6. The mattress base securing system of claim 5, wherein the at least one layer of rigid material is capable of supporting a child weighing up to 30 pounds and resisting a child's efforts to bend or lift the at least one layer.

7. The mattress base securing system of mattress base of claim 5, wherein at least one layer of rigid material is selected from the group of materials consisting of a rigid board, corrugated plastic, honeycomb board, plastic, medium density fiberboard, and wood.

8. The mattress base securing system of claim 5, wherein each panel is further comprised of a second layer of softer material on top of the at least one layer of rigid material.

9. The mattress base securing system of claim 4 wherein the hinges are selected from the group consisting of piano style hinges, molded living hinges and a bendable strip.

10. The mattress base securing system of claim 1, further comprising a mattress base which comprises a plurality of panels configured by sufficient structure and firmness to the panels to prevent the panels from overlapping each other and from pulling out from under the stops.

11. A method of installing a mattress base having at least four corners and at least four edges, into a play yard having four corner posts and at least two stops with each stop attached to one corner post and configured to move under downward pressure of the mattress base during installation and bounce back to an engaged position when the mattress base is installed, the method comprising the steps of:

positioning the mattress base wherein one of the mattress base corners or edges is engaged with each stop; and exerting downward pressure on the mattress base sufficient to move the stops allowing the mattress base to advance fully within the play yard and have each of the stops bounce back to an engaged position to create a secured and supportive surface for a child, wherein the at least two stops are secured above and in close proximity to the mattress base.

12. The method of claim 11, further including at least two brackets below and in close proximity to the mattress base.

13. A folding play yard for holding a child, the play yard comprising:

at least four upper rails;

at least four corner posts inter-connected by the at least four upper rails to form a rectangular play yard;

a floor spanning the area between the at least four corner posts;

a mattress base with at least four corners;

at least two stops located on the at least two diagonally opposing corner posts at a predetermined position above the mattress base and that operate to receive and secure at least two corners of the mattress base from being lifted upward, with each stop attached to one corner post configured to move under downward pressure of the mattress base during installation and bounce back to an engaged position when the mattress base is installed.

14. The folding play yard of claim 13, wherein the mattress base is comprised of a plurality of pivotably connected panels wherein at least two adjacent panels adjacent to a perimeter of the play yard unfold in an inverted-V shape towards the floor.

15. The folding play yard of claim 14, further comprising a plurality of hinges that connect the plurality of panels to one another.

16. The folding play yard of claim 14, wherein each panel is comprised of at least one layer of a rigid material.

17. A mechanism to secure a mattress base having an upper side and at least four edges within a play yard having at least four sides and at least four corners, the mechanism comprising a plurality of stops located along the play yard's sides and in close proximity to the upper side of the mattress base so that the mattress base's edges are located under the stops when the mattress base is installed in the play yard, wherein each stop is attached to one corner post and is configured to move under downward pressure of the mattress base during installation and bounce back to an engaged position when the mattress base is installed.

18. The mechanism of claim 17, comprising the use of four stops inside a play yard having two longer sides and two shorter sides.

19. A mattress base and mattress base securing system for use with a child's play yard, the play yard having a plurality of upper rails, a plurality of corner posts defining an inside perimeter of the play yard, and a floor, the mattress base and mattress base securing system comprising:

a mattress base including a plurality of pivotably connected panels wherein each panel is configured in size and shape so that the plurality of pivotably connected panels cover the play yard floor when the panels are fully unfolded, and a plurality of hinges that connect the plurality of panels to one another, wherein all of the plurality of panels unfold in an inverted-V shape towards the play yard floor; and a plurality of stops located in close proximity to an upper side of the mattress base so that edges of the mattress base are located under the stops when the mattress base is installed in the play yard, wherein each stop is attached to one corner post and is configured to move under downward pressure of the mattress base during installation and bounce back to an engaged position when the mattress base is installed.

20. A mattress for use with a child's play yard comprising:

a plurality of panels arranged side by side on a lower side of the mattress, wherein adjacent panels meet at a panel juncture;

a plurality of anti-slip strips that are attached to the panels and configured to prevent the panels from slipping on top of one another, wherein each anti-slip strip is secured at one end to a panel adjacent to another panel and the opposing, unattached end extends at least two inches across the adjacent panel, wherein each panel juncture has two pairs of anti-slip strips crossing the juncture, wherein each pair of anti-slip strips has one anti-slip strip attached to one panel and the other anti-slop strip attached to the adjacent panel; and a mattress cover coupled to and extending across the plurality of panels that holds the panels adjacent to one another and wherein the cover is configured to fold at each panel juncture.

21. The mattress of claim 20, also comprising edge covers over the panels at panel junctures.

22. The mattress of claim 20, also comprising a mattress closing mechanism to secure the mattress in a closed position.

23. The mattress of claim 22, also comprising a handle to carry the closed mattress.

* * * * *